US012723496B2

(12) United States Patent
Eitschberger

(10) Patent No.: US 12,723,496 B2
(45) Date of Patent: Sep. 1, 2026

(54) WELLBORE TOOL WITH EXTERNALLY-OPERATED BALLISTIC INTERRUPT

(71) Applicant: DynaEnergetics Europe GmbH, Troisdorf (DE)

(72) Inventor: Christian Eitschberger, Munich (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 19/287,282

(22) Filed: Jul. 31, 2025

(65) Prior Publication Data

US 2026/0036024 A1 Feb. 5, 2026

Related U.S. Application Data

(60) Provisional application No. 63/677,868, filed on Jul. 31, 2024.

(51) Int. Cl.
*E21B 43/1185* (2006.01)
*E21B 43/119* (2006.01)

(52) U.S. Cl.
CPC ..... *E21B 43/1185* (2013.01); *E21B 43/119* (2013.01)

(58) Field of Classification Search
CPC ... E21B 43/1185; E21B 43/119; E21B 43/116
See application file for complete search history.

(56) References Cited

U.S. PATENT DOCUMENTS

| | | | | |
|---|---|---|---|---|
| 3,176,770 | A * | 4/1965 | Ehlert | E21B 47/092 166/55.3 |
| 8,887,818 | B1 | 11/2014 | Carr et al. | |
| D873,373 | S | 1/2020 | Hartman et al. | |
| D877,286 | S | 3/2020 | Hartman et al. | |
| 11,414,951 | B2 | 8/2022 | Hartman et al. | |
| D971,372 | S | 11/2022 | Hartman et al. | |
| 11,555,385 | B2 | 1/2023 | Ursi et al. | |
| 11,649,684 | B2 | 5/2023 | Garg et al. | |
| 12,049,791 | B2 | 7/2024 | Garg et al. | |
| 2019/0368321 | A1* | 12/2019 | Eitschberger | E21B 23/10 |
| 2020/0199982 | A1* | 6/2020 | Quattlebaum | E21B 43/1185 |
| 2023/0230787 | A1* | 7/2023 | Yakeley | H01H 50/32 335/207 |
| 2024/0352833 | A1 | 10/2024 | McFarland et al. | |

FOREIGN PATENT DOCUMENTS

| | | | |
|---|---|---|---|
| CA | 3184249 | A1 | 1/2022 |
| CA | 3225724 | A1 | 1/2023 |
| WO | 2021/178847 | A1 | 9/2021 |
| WO | 2022/006411 | A1 | 1/2022 |
| WO | 2023/004353 | A1 | 1/2023 |

* cited by examiner

*Primary Examiner* — David Carroll

(74) *Attorney, Agent, or Firm* — Womble Bond Dickinson (US) LLP

(57) ABSTRACT

A ballistic interrupt assembly may include an interrupt, a magnet coupled to the interrupt, an activator block formed of a magnetizable material and configurable between a non-magnetized state and a magnetized state, a bias element provided between the magnet and the activator block. A bias force of the bias element may be greater than a first magnetic attraction force between the magnet and the activator block in the non-magnetized state. The bias force of the bias element may be less than a second magnetic attraction force between the magnet and the activator block in the magnetized state.

20 Claims, 28 Drawing Sheets

Magnetic repulsion

Magnetic attraction

WELLBORE TOOL WITH EXTERNALLY-OPERATED BALLISTIC INTERRUPT

This application claims priority to U.S. Provisional Patent Application No. 63/677,868 filed Jul. 31, 2024, the entire contents of which are incorporated herein by reference.

BACKGROUND

The present disclosure relates to oil and gas wellbore perforating equipment, specifically perforating guns and their methods of assembly. Perforating guns and other wellbore tools are specialized assemblies that include explosives and are deployed into oil and gas wells where the explosives are detonated to "perforate" hydrocarbon-containing underground formations, for extracting fossil fuels and natural gas from the underground formations.

More specifically, the perforating process involves carrying explosive charges downhole (into the well) and positioning them at a desired depth in order to open up communication to the rock and embedded hydrocarbons upon detonation of the explosives. The shaped charges open up tunnels through the wellbore casing lining the well and radially outward into the surrounding formation. The perforation tunnels act as conduits through which reservoir fluids flow from the formation into the wellbore and up to the surface during the production phase of the well. Each perforation creates a channel that allows the oil and/or gas to leave the rock and enter the oil or gas well. The same tunnels can be used during hydraulic fracturing and stimulation processes to aid in freeing the hydrocarbons from the formation.

Perforating guns are the vessels used to transport and deliver the explosive shaped charges within the wellbore and they come in a variety of sizes and configurations. Operators may install a particular type of well equipment to accommodate a perforating system that is suitable for a specific reservoir based on its characteristics. Several perforating guns and other wellbore tool 102*s* may be connected together in a "tool string" of guns and/or wellbore tool 102*s* for deployment together into the wellbore. For brevity and clarity in this disclosure, reference is made to a "gun string" or "perforating gun string" which includes at least two connected perforating guns but may also include other wellbore tool 102*s*. In other words, "gun string" and "tool string" may be considered synonymous unless the context makes a distinction.

Many factors are considered in the design and selection of the gun system and other elements of the gun string—the assembly of tools threaded end-to-end that make up the full system used to perforate the wellbore. The design may factor in the objectives of maximizing communication with the surrounding reservoir over a desired interval or length (i.e., the pay zone), the system and operational costs, and safety and reliability. Safety is a constant concern for all personnel handling these highly energetic materials.

Assembly of a perforating gun may require assembly of multiple parts. Such parts may include a housing 104 or outer gun barrel containing or connected to perforating gun internal components such as: an electrical wire for relaying an electrical control signal such as a detonation signal from the surface to electrical components of the perforating gun; an electrical, mechanical, and/or explosive initiator 108 such as a percussion initiator 108, an igniter, and/or an initiator 108; a detonating cord 110; one or more explosive and/or ballistic charges which are held in an inner tube, strip, or other carrying device; and other known components including, for example, a first booster 114, a sealing element, a positioning and/or retaining structure, a circuit board, and the like as would be understood within the perforating gun industry.

The internal components may require assembly including connecting electrical components within the housing and confirming and maintaining the connections and relationships between internal components. The assembly procedure may be difficult within the relatively small free space within the housing 104. Examples of connections may include connecting the electrical relay wire to the initiator 108 or the circuit board, coupling the initiator 108 and the detonating cord 110 and/or the first booster 114, and positioning the detonating cord 110 in a retainer at an initiation point of each charge. In addition, typical perforating guns may not provide components that are size-independent and therefore available for use in different perforating guns with, e.g., different gun housing 104 inner diameters.

The housing may also be connected at each end to a respective adjacent wellbore tool or other component of the tool string such as a firing head or tandem seal adapter (or other sub assembly) or the like. Connecting the housing to the adjacent component(s) may include screwing the housing and the adjacent component(s) together via complementary threaded portions of the housing and the adjacent components and forming a connection and seal therebetween.

The explosive charges may be shaped, hollow, or projectile charges, which are initiated, e.g., by the detonating cord, to perforate holes in the casing and to blast through the formation so that the hydrocarbons can flow through the casing. In other operations, the charges may be used for penetrating just the casing, e.g., during abandonment operations that require pumping concrete into the space between the wellbore and the wellbore casing, destroying connections between components, severing a component, and the like. The exemplary embodiments in this disclosure may be applicable to any operation consistent with this disclosure. For purposes of this disclosure, the term "charge" and the phrase "shaped charge 112" may be used interchangeably and without limitation to a particular type of explosive, charge, or wellbore operation, unless expressly indicated.

The explosive charges may be arranged and secured within the housing by the carrying device which may be, e.g., a hollow charge carrier or other holding device that receives and/or engages the shaped charge and maintains an orientation thereof. The charges may be arranged in different phasing, such as 60°, 90°, 120°, 180°, 270°, etc. along the length of the charge carrier, so as to form, e.g., a helical pattern along the length of the charge carrier. Charge phasing generally refers to the radial distribution of charges throughout the perforating gun, or, in other words, the angular offset between respective radii along which successive charges in a charge string extend in a direction away from an axis of the charge string. An explosive end of each charge points outwardly along a corresponding radius to fire an explosive jet through the gun housing 104 and wellbore casing, and/or into the surrounding rock formation. Phasing the charges therefore generates explosive jets in a number of different directions and patterns that may be variously desirable for particular applications. On the other hand, it may be beneficial to have each charge fire in the same radial direction. A charge string in which each charge fires in the same radial direction would have zero-degree (0°) phasing. Still further, shaped charge 112*s* that are gravitationally, mechanically, or manually oriented within the wellbore may be beneficial in certain applications. Ensuring the orientation of the shaped charge 112*s* before firing may also be a critical step for ensuring accurate and effective perforating and therefore eliminating the need for multiple perforating operations for a single section of the wellbore.

Once the perforating gun(s) is properly positioned, a surface signal actuates an ignition of a fuse or initiator 108, which in turn initiates the detonating cord, which detonates the explosive charges to penetrate/perforate the housing and wellbore casing, and/or the surrounding rock formation to allow formation fluids (e.g., oil and gas) to flow through the perforations thus formed and into a production string including the wellbore casing from which it is recovered at the surface.

The initiator 108, upon receiving an electrical signal, current, percussive force, or a pressure increase (or other initiation, depending upon the type of firing system) from the surface, starts the explosive chain reaction which transfers along the detonating cord from the initiator 108 to the shaped charges. Each perforating gun may have a separate length of detonating cord. When perforating guns are conveyed into the wellbore using a wireline, which is a cable that holds the weight of the string and also provides electrical connectivity, then a wired connection can be made directly from the surface to an initiator 108 located within or near the guns.

To detonate charges in a perforating gun, equipment operators can relay an electrical signal or current from the surface via electrical wires to one or more initiator 108*s* within a string of perforating guns. Selective (or, "select-fire") perforating (or detonation) is the practice of firing a subset of the perforating guns on a single string. Equipment operators can perforate one zone or interval of a wellbore, move the perforating gun string, and then perforate a second zone. This process provides efficiency gains and cost savings to the operator during the well completion process. Select-fire systems require safe and efficient techniques for sending firing commands to the respective initiator 108 in each perforating gun (and/or other tools) in the tool string. Select-fire systems may use digital communication in which each initiator 108 has a unique digital address. Such systems may also have an electrical feedthrough—e.g., wires and/or electrical connectors—to relay the electrical signal (i.e., firing command) through each perforating gun/tool and between adjacent perforating guns/tools until it reaches the initiator 108 to which it is addressed.

In view of the above, it may be desirable to develop improvements in perforating gun technology to help ensure safety and reliable assembly of perforating guns. For example, there may be a need for improved ballistic interrupt 116*s* to ensure safe shipping and assembly of perforating guns. Further, there may be a need for a perforating gun structure that allows for efficient, reliable, and verifiable arming of the perforating gun from an exterior of the gun in order to reduce the need for direct handling, wiring, and assembly of the perforating gun components. Still further, there may be a need for improved structures to allow for reversal of the arming if there is a need to remove the perforating gun from the wellbore.

At least an exemplary embodiment of a ballistic interrupt assembly may include an interrupt, a magnet coupled to the interrupt, an activator block formed of a magnetizable material and configurable between a non-magnetized state and a magnetized state, a bias element provided between the magnet and the activator block. A bias force of the bias element may be greater than a first magnetic attraction force between the magnet and the activator block in the non-magnetized state. The bias force of the bias element may be less than a second magnetic attraction force between the magnet and the activator block in the magnetized state.

At least an exemplary embodiment of a wellbore tool may include a housing, an explosive component holder disposed within the housing, and a ballistic interrupt assembly. The explosive component holder may include a first channel configured for receiving a first explosive component and second channel configured for receiving a second explosive component. The ballistic interrupt assembly may include an interrupt movable between a first position and a second position. In the first position, the interrupt may block ballistic transfer between the first channel and the second channel such that the wellbore tool is unarmed. In the second position, the interrupt may allow ballistic transfer between the first channel and the second channel such that the perforating gun is armed. The interrupt may be configured to move from the first position to the second position via application of a magnetic field to the wellbore tool.

At least an exemplary embodiment of a wellbore tool arming method may include providing a wellbore tool. The wellbore tool may include a housing, an explosive component holder disposed within the housing, and a ballistic interrupt assembly. The explosive component holder may include a first channel configured for receiving a first explosive component and a second channel configured for receiving a second explosive component. The ballistic interrupt assembly may include an interrupt, a magnet coupled to the interrupt, an activator block formed of a magnetizable material and configurable between a non-magnetized state and a magnetized state, and a bias element provided between the magnet and the activator block. A bias force of the bias element may be greater than a first magnetic attraction force between the magnet and the activator block in the non-magnetized state. The bias force of the bias element may be less than a second magnetic attraction force between the magnet and the activator block in the magnetized state. The interrupt may be movable between a first position in which at least a portion of the interrupt is positioned between the first channel and the second channel and a second position in which the interrupt is displaced from between the first channel and the second channel. The method may further include moving the interrupt from the first position to the second position.

BRIEF DESCRIPTION OF THE SEVERAL VIEWS OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1A:
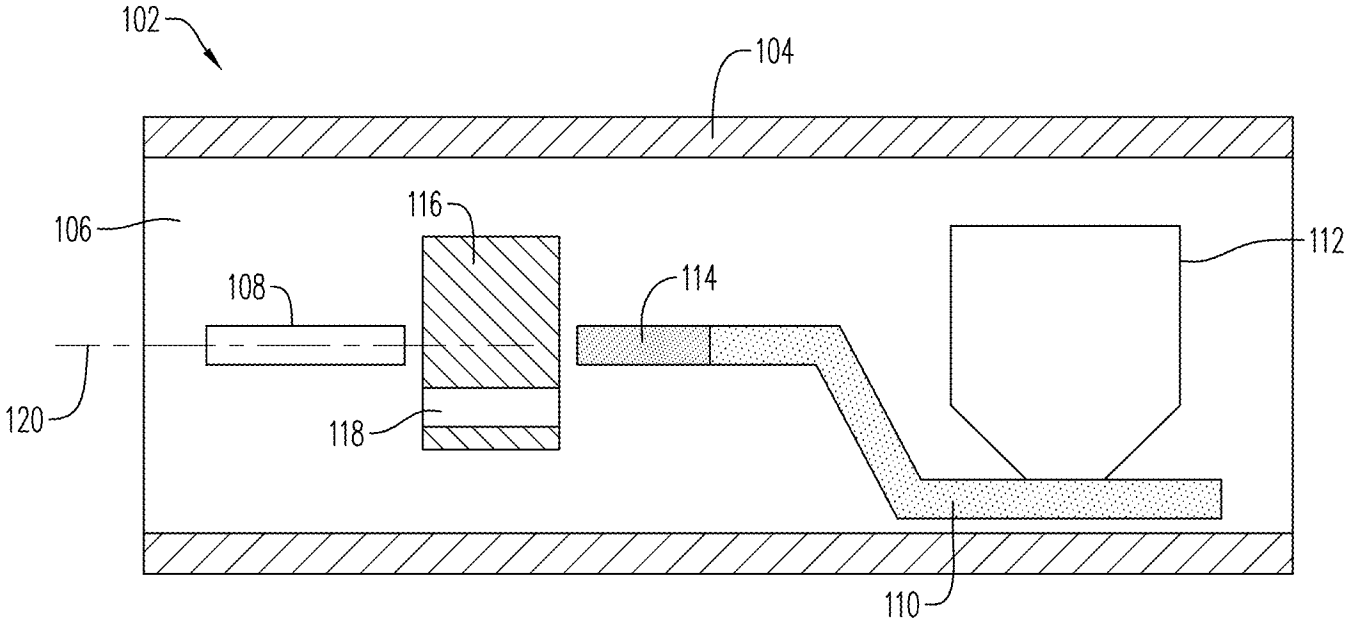
FIG. 1A is a cross-section view of a wellbore tool with a ballistic interrupt according to an exemplary embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some exemplary embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various exemplary embodiments. Each example is provided by way of explanation and is not meant as a limitation and does not constitute a definition of all possible embodiments.

For purposes of this disclosure, relative terms including, without limitation, "top," "bottom," "rear," "front," "upper," "lower," "above," "below," "within," and the like are used to aid the description of, e.g., configurations of features as shown in the accompanying figures, and otherwise as the disclosure makes clear. Such relative terms do not imply any particular dimension or delineation of or between features except where the disclosure makes clear.

For purposes of this disclosure, terms including, without limitation, "first," "second," "third," and "fourth" are used for descriptive purposes only and without limitation with respect to, e.g., an ordering of process steps, function, or configuration.

For purposes of this disclosure, "substantially" means generally consistent with the spirit of the disclosure but without limitation to any particular measure.

For purposes of illustrating features of the embodiments, an exemplary embodiment will now be introduced and referenced throughout the disclosure. It will be understood that this example and other exemplary embodiments described in this disclosure are illustrative and not limiting and are provided for illustrating the exemplary features.

FIG. 1A shows an exemplary embodiment of a wellbore tool 102 with a ballistic interrupt. The wellbore tool 102 may have a housing 104 defining an interior 106. A number of components such as an initiator 108 and an explosive component such as a detonating cord 110 and/or a shaped charge 112 may be provided within the interior 106 of the housing 104. A first booster 114 may be provided at a first end of the detonating cord 110. The detonating cord 110 may be positioned proximate to the shaped charge 112 such that detonation of the detonation cord would detonate the shaped charge 112. An interrupt 116 may be positioned between the initiator 108 and the first booster 114 of the detonating cord 110 in an axial direction of the housing 104. Alternatively, if just a detonating cord 110 is present without a first booster 114, the interrupt 116 may be positioned between the initiator 108 and the detonating cord 110 in the axial direction. In an exemplary embodiment, the interrupt 116 may be made of a magnetic material, or may include at least a portion made of a magnetic material.

The interrupt 116 may include a passage 118 extending through the interrupt 116 in the axial direction. The interrupt 116 be movable between an unarmed position (e.g., see FIG. 1A) and an armed position (e.g., see FIG. 1B). In FIG. 1A, the interrupt 116 is in the unarmed position. In the unarmed position, the body of the interrupt 116 blocks any detonation from the initiator 108 from reaching the first booster 114 or detonating cord 110. In other words, the interrupt 116 breaks the ballistic transfer between the initiator 108 and the first booster 114 or detonating cord 110, thereby preventing the detonating cord 110, and consequently, the shaped charge 112, from detonating. As seen in FIG. 1A, the passage 118 of the interrupt 116 is displaced from the initiator 108 such that the passage 118 is displaced from a longitudinal axis 120 of the initiator 108 in a radial direction.

Figure 1B:
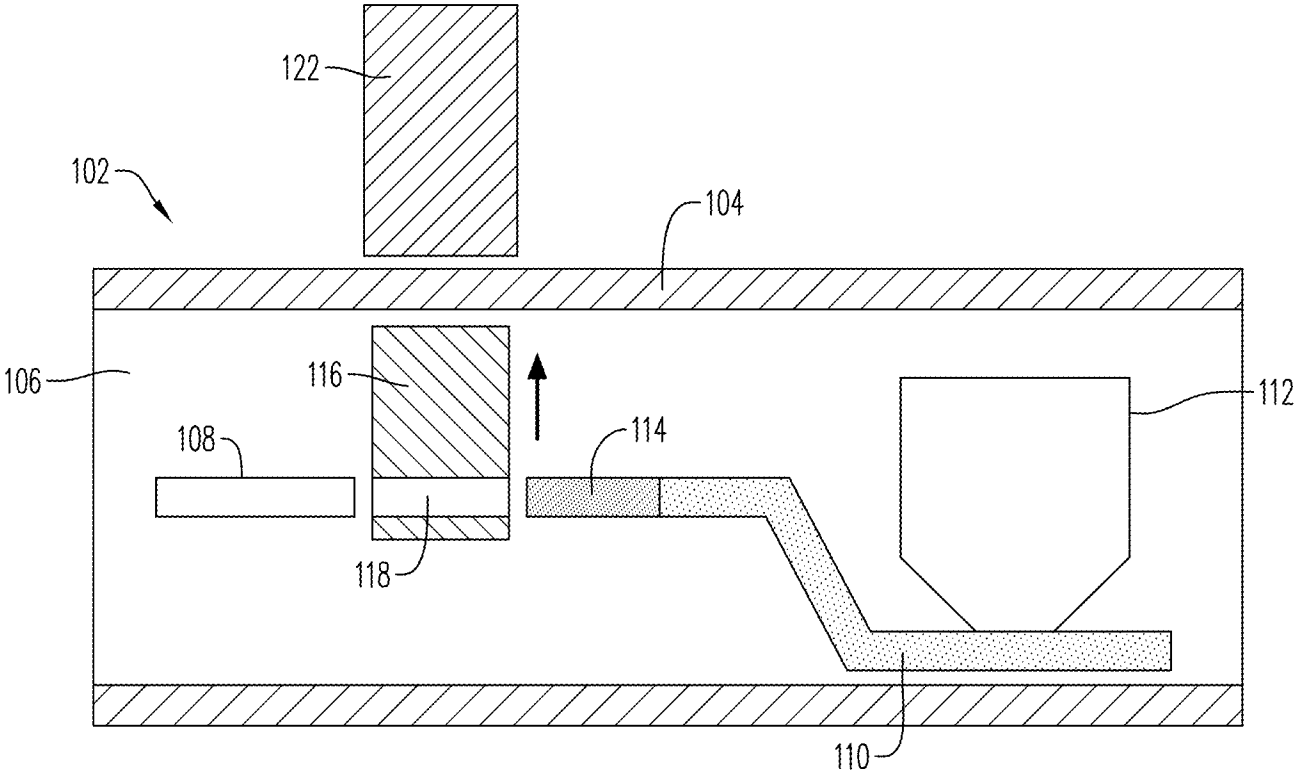
FIG. 1B is a cross-section view of a wellbore tool with a ballistic interrupt according to an exemplary embodiment.

FIG. 1B shows the interrupt 116 in an armed position. In the armed position, the interrupt 116 has shifted so that the passage 118 becomes axially aligned with the initiator 108 and the first booster 114. Thus, if the initiator 108 is initiated while the interrupt 116 is in the armed position, the detonation from the initiator 108 travels through the passage 118 of the interrupt 116 and detonates the first booster 114 or detonating cord 110, and subsequently, the shaped charge 112. In other words, when the interrupt 116 is in the armed position, the passage 118 of the interrupt 116 facilitates ballistic transfer from the initiator 108 to the first booster 114 or detonating cord 110.

In an exemplary embodiment, the movement of the interrupt 116 from the unarmed position to the armed position may be accomplished from an exterior of the housing 104, without having to directly touch or manipulate any parts within the housing 104. In other words, the movement from the unarmed position to the armed position is accomplished via a manipulation occurring at an exterior of the housing 104. In an exemplary embodiment, this may be accomplished by the use of a magnet 122. For example, at a wellbore site, a worker or automated machine may bring a tool such as the magnet 122 or an electromagnet to a predetermined point on an exterior of the housing 104. The proximity of the magnet 122 may generate a magnetic field that interacts with the interrupt 116 and moves the interrupt 116 from the unarmed position to the armed position through magnetic attraction. In other words, the magnet 122 draws the interrupt 116 to the armed position through magnetic attraction. It will be understood that the movement of the interrupt 116 from the unarmed position to the armed position is not limited to magnetic attraction. For example, depending on the magnetic properties of the interrupt 116 and the magnet 122, a magnet 122 could also be placed on an opposite side of the housing 104 to push the interrupt 116 to the armed position through magnetic repulsion. In the embodiment shown in FIG. 1A and FIG. 2A, the interrupt 116 moves along a radial direction perpendicular to the axial direction of the housing 104. After the interrupt 116 is moved to the armed position, the wellbore tool 102 becomes armed and may be deployed to the wellbore.

Figure 2A:
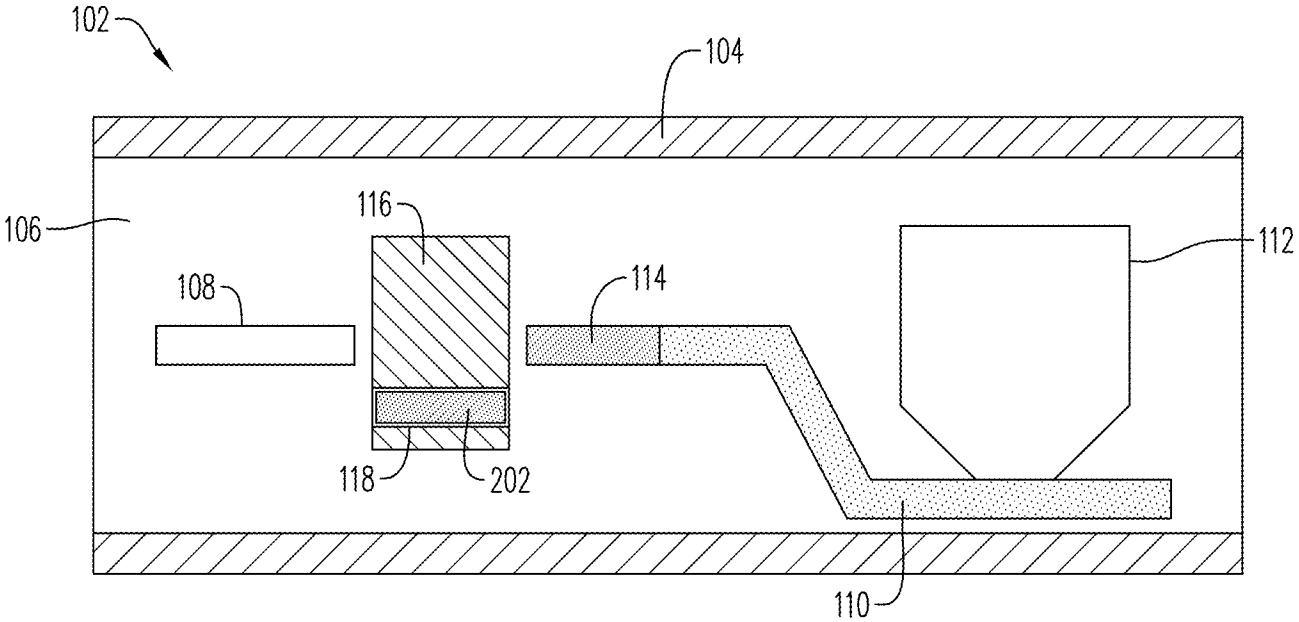
FIG. 2A is a cross-section view of a wellbore tool with a ballistic interrupt according to an exemplary embodiment.
Figure 2B:
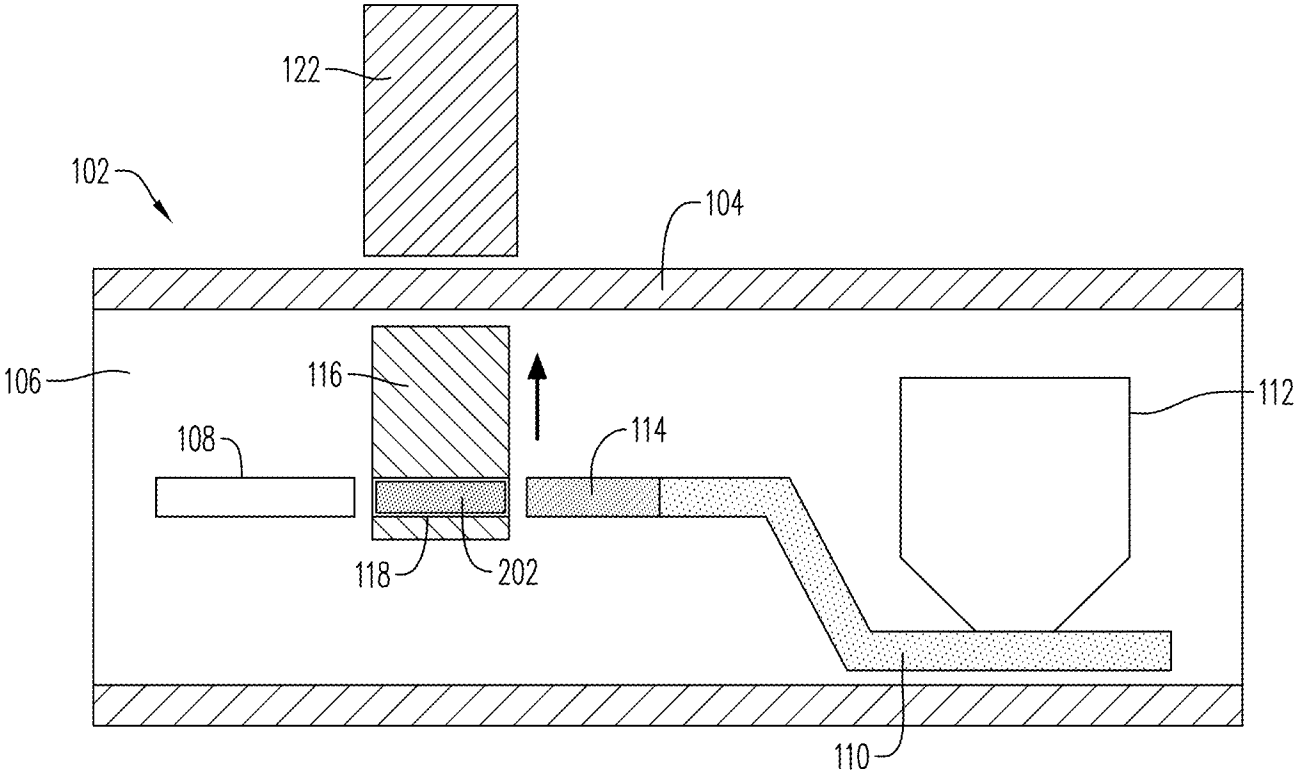
FIG. 2B is a cross-section view of a wellbore tool with a ballistic interrupt according to an exemplary embodiment.

FIG. 2A and FIG. 2B show another exemplary embodiment of a wellbore tool having a ballistic interrupt. FIG. 2A shows the wellbore tool 102 in an unarmed position, and FIG. 2B shows the wellbore tool 102 in an armed position. The interrupt 116 in FIG. 2A and FIG. 2B is similar to that of FIG. 1A and FIG. 1B, except that a second booster 202 or booster material is provided within the passage 118 of the interrupt 116. In this embodiment, when the initiator 108 is initiated, it in turn detonates the second booster 202 within the passage 118, which then subsequently detonates the first booster 114/detonating cord 110. By providing the second booster 202 in the passage 118 of the interrupt 116, the ballistic transfer between initiator 108 and the detonating cord 110 may become more reliable.

Figure 3A:
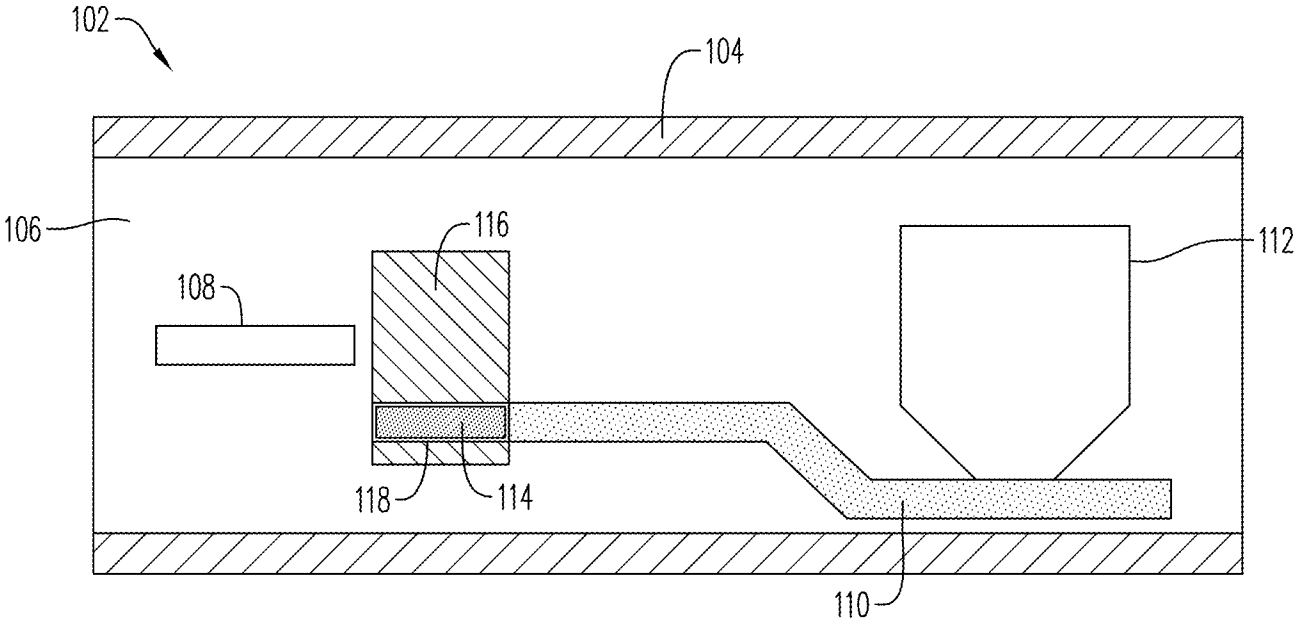
FIG. 3A is a cross-section view of a wellbore tool with a ballistic interrupt according to an exemplary embodiment.
Figure 3B:
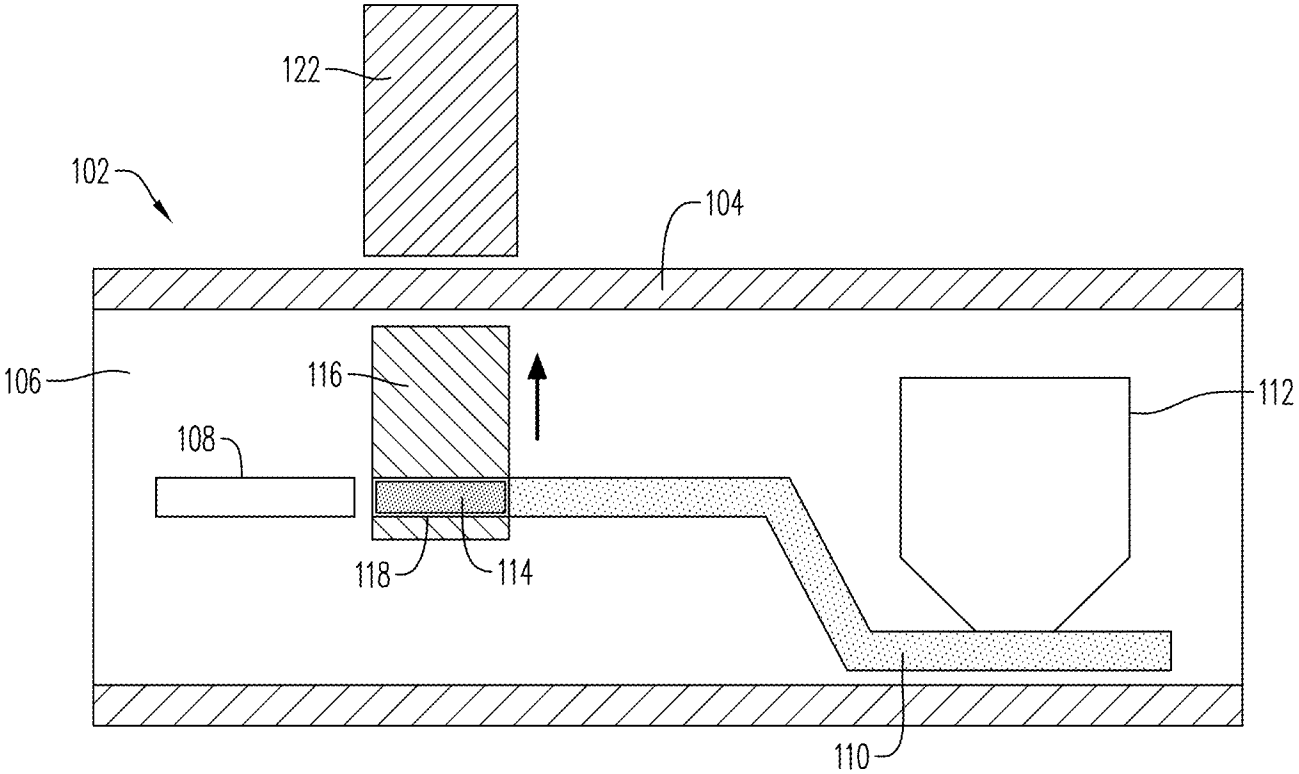
FIG. 3B is a cross-section view of a wellbore tool with a ballistic interrupt according to an exemplary embodiment.

FIG. 3A and FIG. 3B show another exemplary embodiment of a wellbore tool having a ballistic interrupt. FIG. 3A shows the wellbore tool 102 in an unarmed position, and FIG. 3B shows the wellbore tool 102 in an armed position. In the embodiment of FIG. 3A and FIG. 3B, a first booster 114 is provided within the interrupt 116, and an end of the detonating cord 110 is directly connected to the interrupt 116. The detonating cord 110 may be flexible so that it can bend and shift with the movement of the interrupt 116 as the interrupt 116 shifts from an unarmed position (FIG. 3A) to an armed position (FIG. 3B).

Figure 4A:
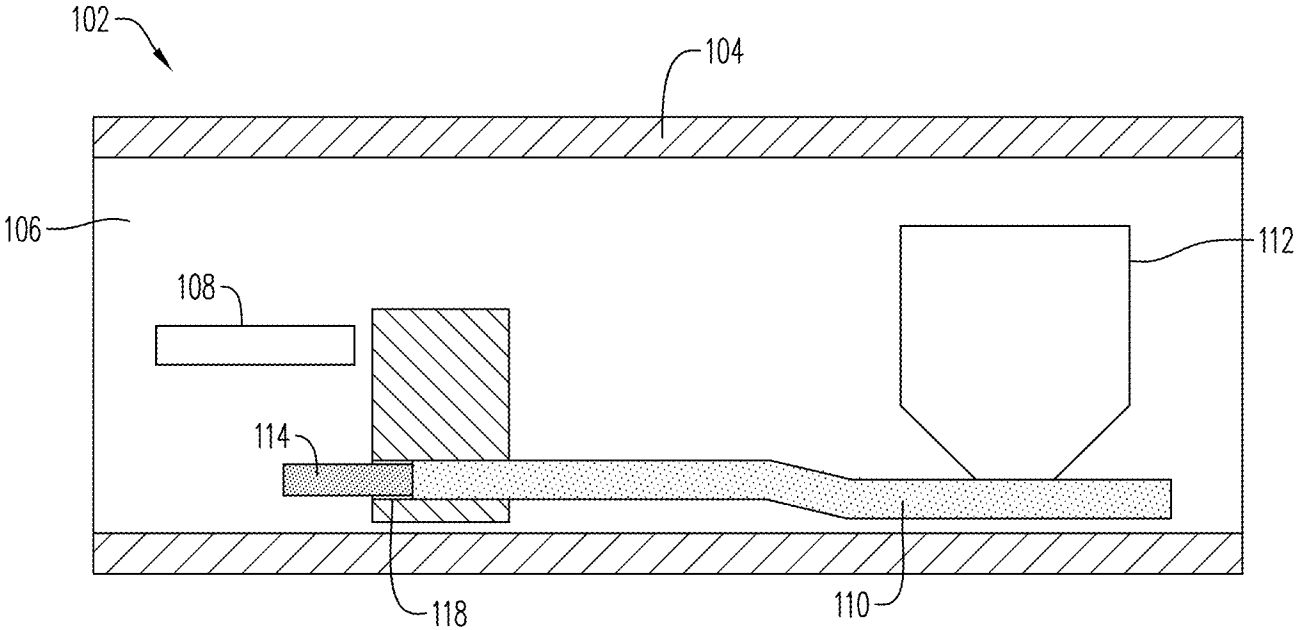
FIG. 4A is a cross-section view of a wellbore tool with a ballistic interrupt according to an exemplary embodiment.
Figure 4B:
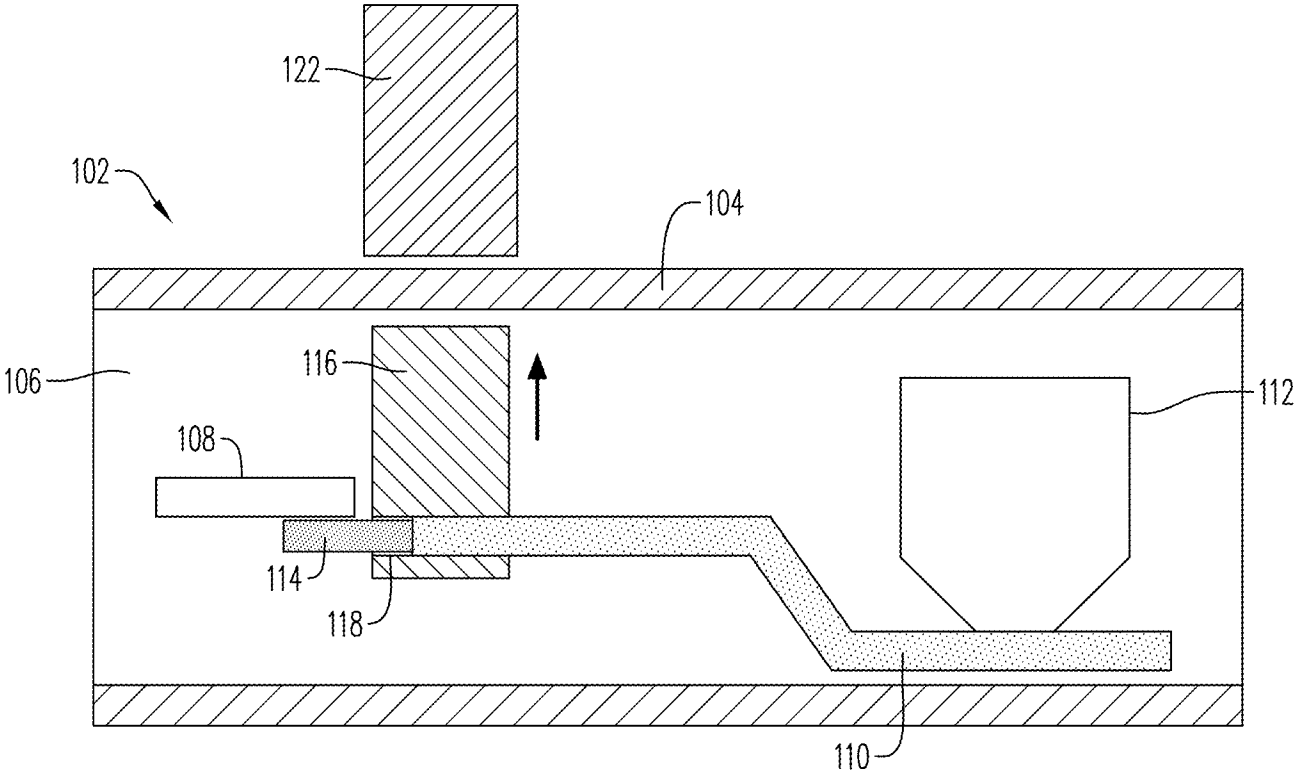
FIG. 4B is a cross-section view of a wellbore tool with a ballistic interrupt according to an exemplary embodiment.

FIG. 4A and FIG. 4B show another exemplary embodiment of a wellbore tool having a ballistic interrupt. FIG. 4A shows the wellbore tool 102 in an unarmed position, and FIG. 4B shows the wellbore tool 102 in an armed position. In the embodiment of FIG. 4A and FIG. 4B, a first booster 114 protrudes from an end of the interrupt 116 on the side of the initiator 108. The end of the detonating cord 110 is inserted into the passage 118 of the interrupt 116 so as to be proximate to the first booster 114. In the unarmed position shown in FIG. 4A, the first booster 114 is sufficiently displaced from the initiator 108 in the radial direction such that detonation of the initiator 108 will not detonate the first booster 114. In the armed position shown in FIG. 4B, the interrupt 116 has moved in the radial direction so that the first booster 114 has become proximate to the initiator 108. In the armed position of FIG. 4B, the first booster 114 is sufficiently close to the initiator 108 such that initiation of the initiator 108 will detonate the first booster 114; i.e., the first booster 114 is radially adjacent to the initiator 108. In other words, in the armed position shown in FIG. 4B, the initiator 108 and the first booster 114 are arranged in a side-by-side initiation configuration.

Figure 5A:
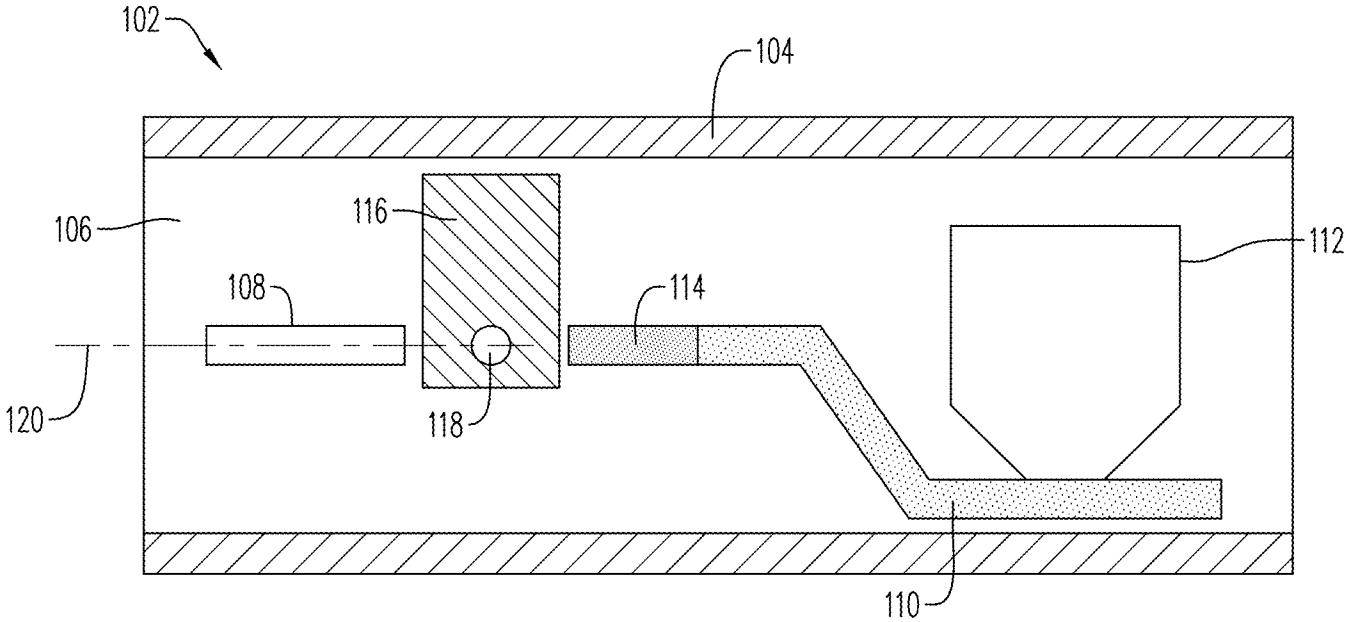
FIG. 5A is a cross-section view of a wellbore tool with a ballistic interrupt according to an exemplary embodiment.
Figure 5B:
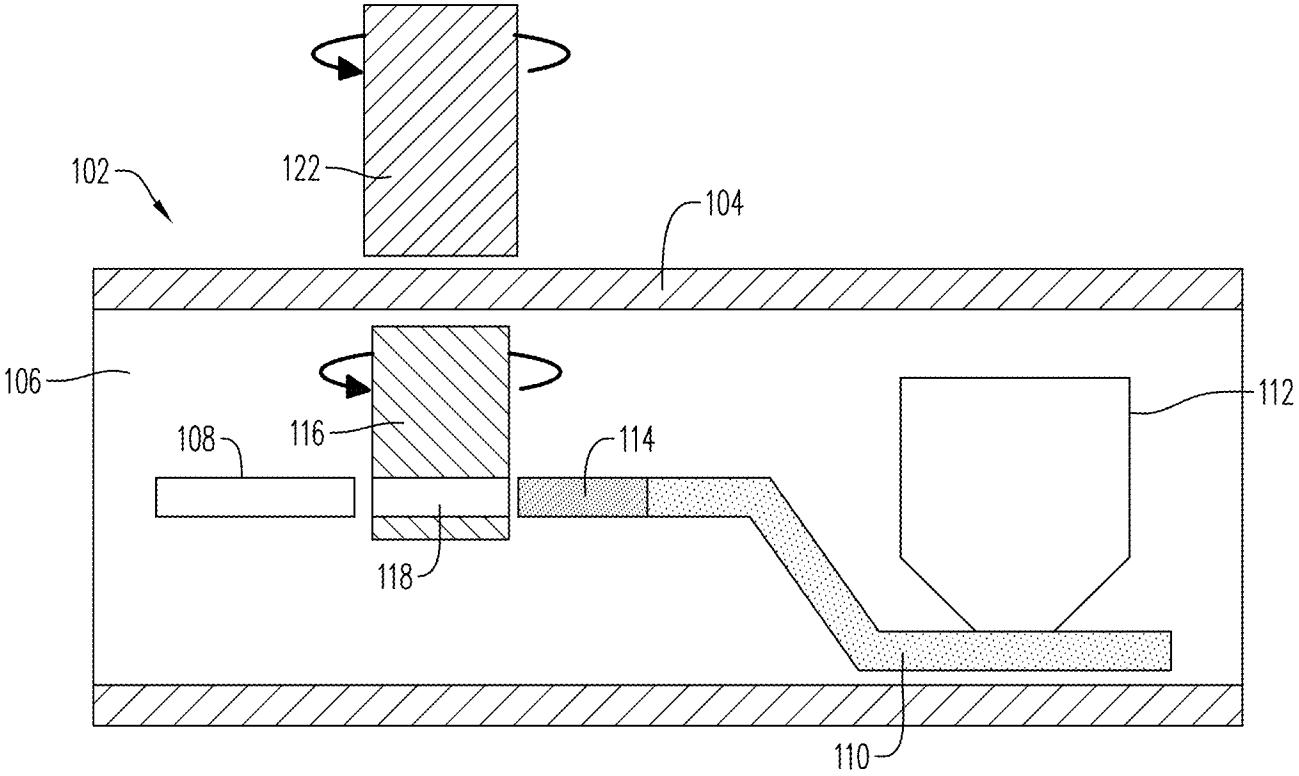
FIG. 5B is a cross-section view of a wellbore tool with a ballistic interrupt according to an exemplary embodiment.

The embodiments above have illustrated movement of the interrupt 116 in the radial direction of the housing 104, but it will be understood that the interrupt 116 is not limited to this type of movement. FIG. 5A and FIG. 5B shown an embodiment in which the interrupt 116 is rotated between an unarmed position (FIG. 5A) and an armed position (FIG. 5B) instead of linearly translating in the radial direction. FIG. 5A shows the interrupt 116 in an unarmed position in which the passage 118 is aligned in a radial direction of the housing 104, i.e., the passage 118 extends into and out of the surface of the sheet of FIG. 5A. Put another way, the passage 118 may be perpendicular to a longitudinal axis 120 of the initiator 108. In this position, the body of the interrupt 116 breaks ballistic transfer from the initiator 108 to the first booster 114 or detonating cord 110.

In the armed position shown in FIG. 5B, the interrupt 116 has rotated so that the passage 118 becomes aligned with the axial direction of the housing 104. As can be seen in FIG. 5B, the passage 118 is now open between the initiator 108 and the first booster 114, thus allowing ballistic transfer from the initiator 108 to the first booster 114.

As shown in FIG. 5B, the interrupt 116 may be moved from the unarmed position to the armed position by rotation of a magnetic field generated by the magnet 122 or an electromagnet. The magnet 122 may be positioned on an exterior surface and rotated such that the interrupt 116 rotates around an axis intersecting with the exterior surface. In an exemplary embodiment, this can be achieved by proper configuration of the magnetic poles of the interrupt 116 and the corresponding magnet 122 used on the exterior surface of the housing 104.

Figure 6A:
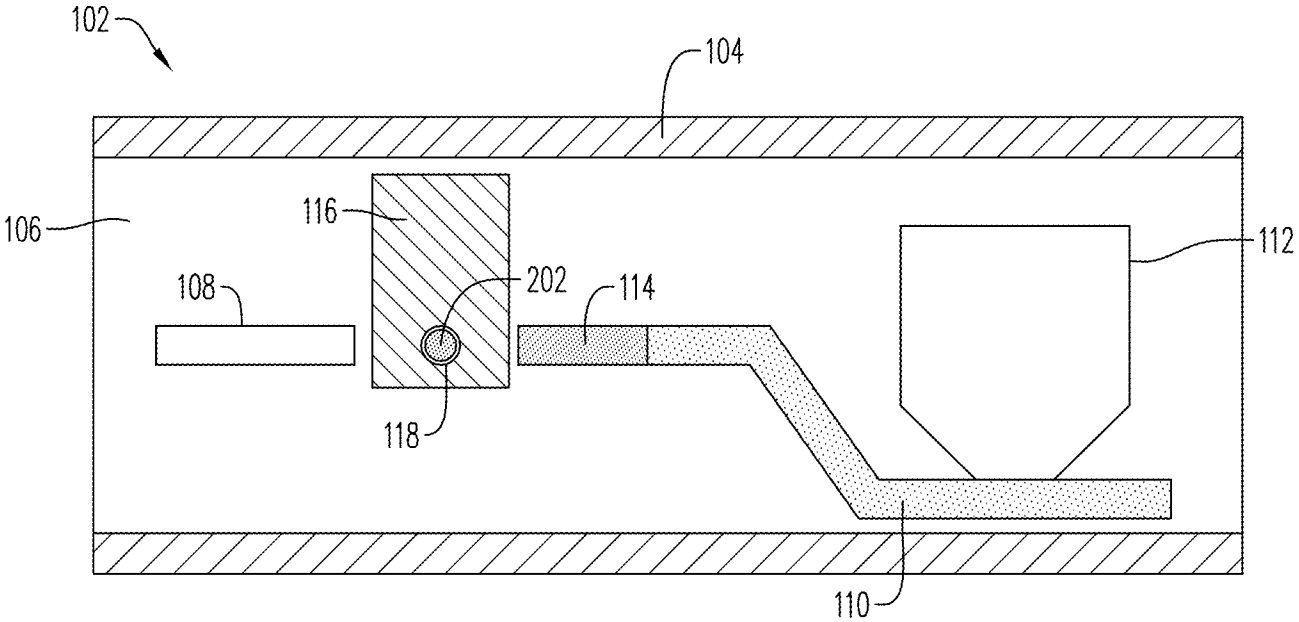
FIG. 6A is a cross-section view of a wellbore tool with a ballistic interrupt according to an exemplary embodiment.
Figure 6B:
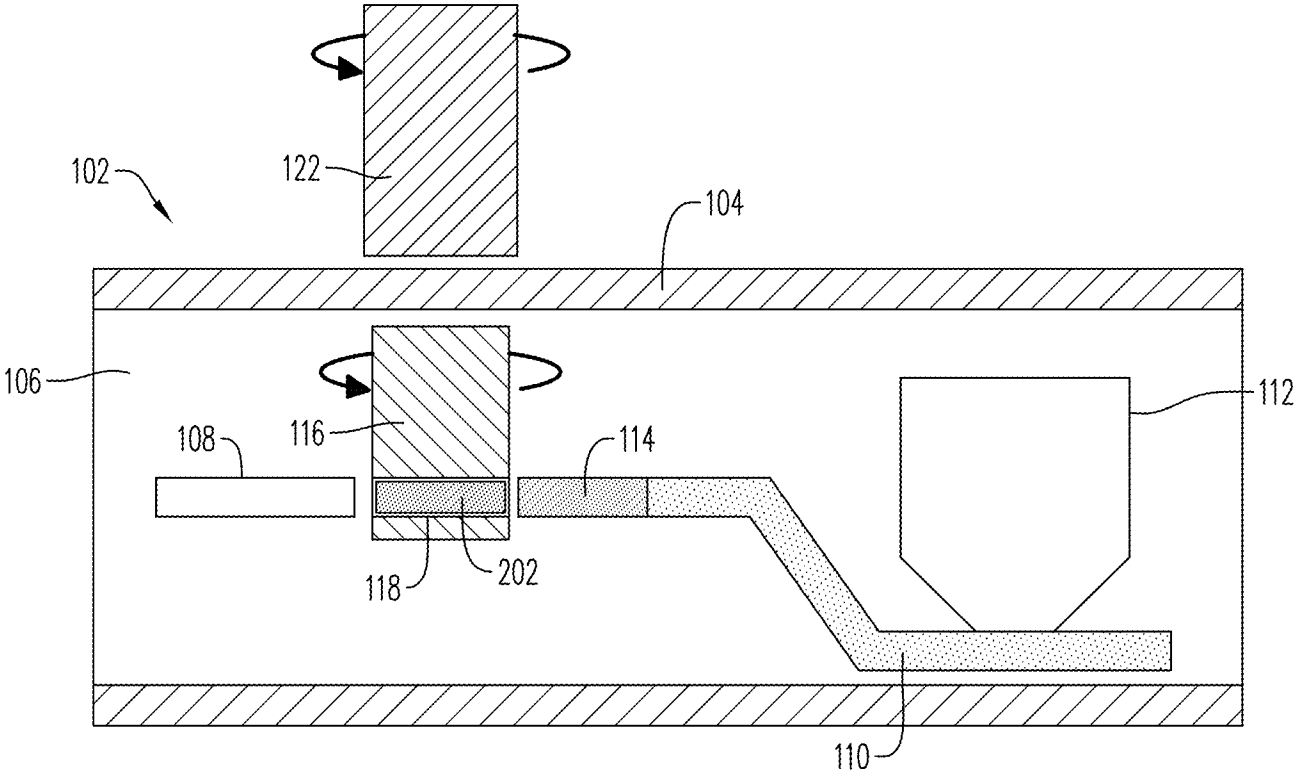
FIG. 6B is a cross-section view of a wellbore tool with a ballistic interrupt according to an exemplary embodiment.

FIG. 6A and FIG. 6B show another exemplary embodiment of a wellbore tool with a ballistic interrupt. FIG. 6A shows the wellbore tool 102 in an unarmed position, and FIG. 6B shows the wellbore tool 102 in an armed position. The embodiment shown in FIG. 6A and FIG. 6B is similar to the embodiment shown in FIG. 5A and FIG. 5B, but with a second booster 202 provided in the passage 118 of the interrupt 116 in order to facilitate a more reliable ballistic transfer between the initiator 108 and the detonating cord 110.

Figure 7A:
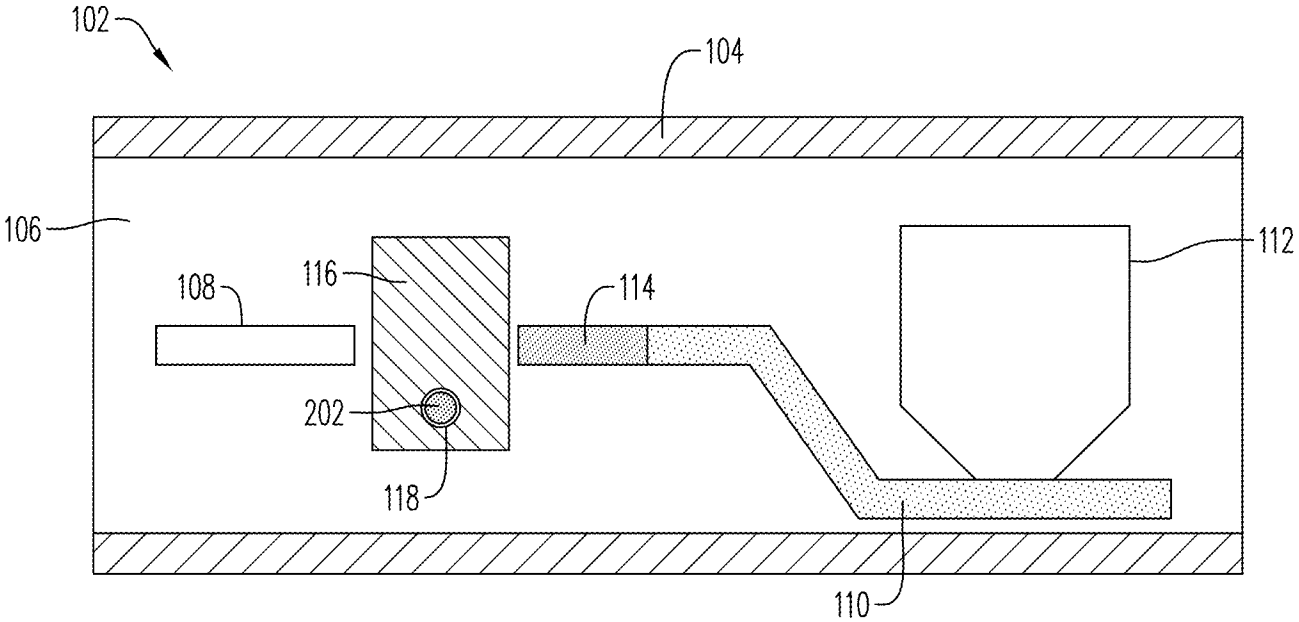
FIG. 7A is a cross-section view of a wellbore tool with a ballistic interrupt according to an exemplary embodiment.
Figure 7B:
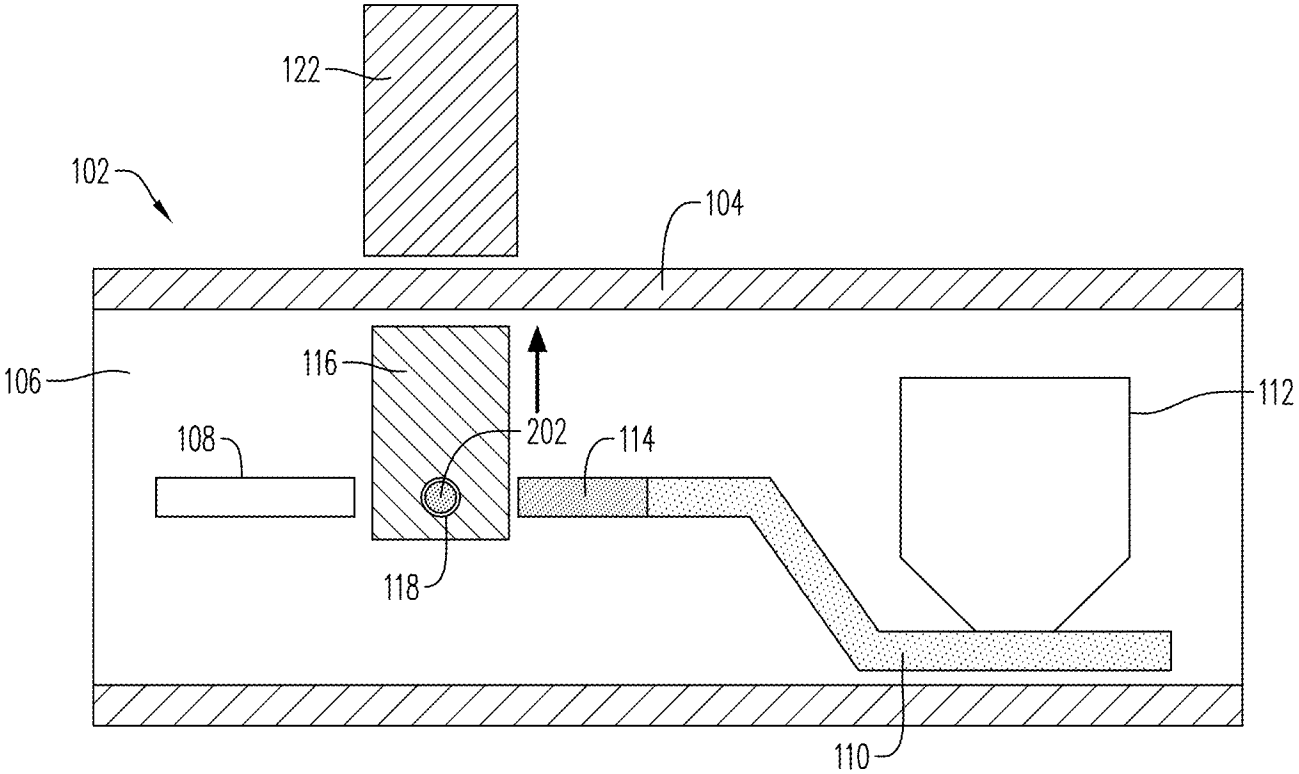
FIG. 7B is a cross-section view of a wellbore tool with a ballistic interrupt according to an exemplary embodiment.
Figure 7C:
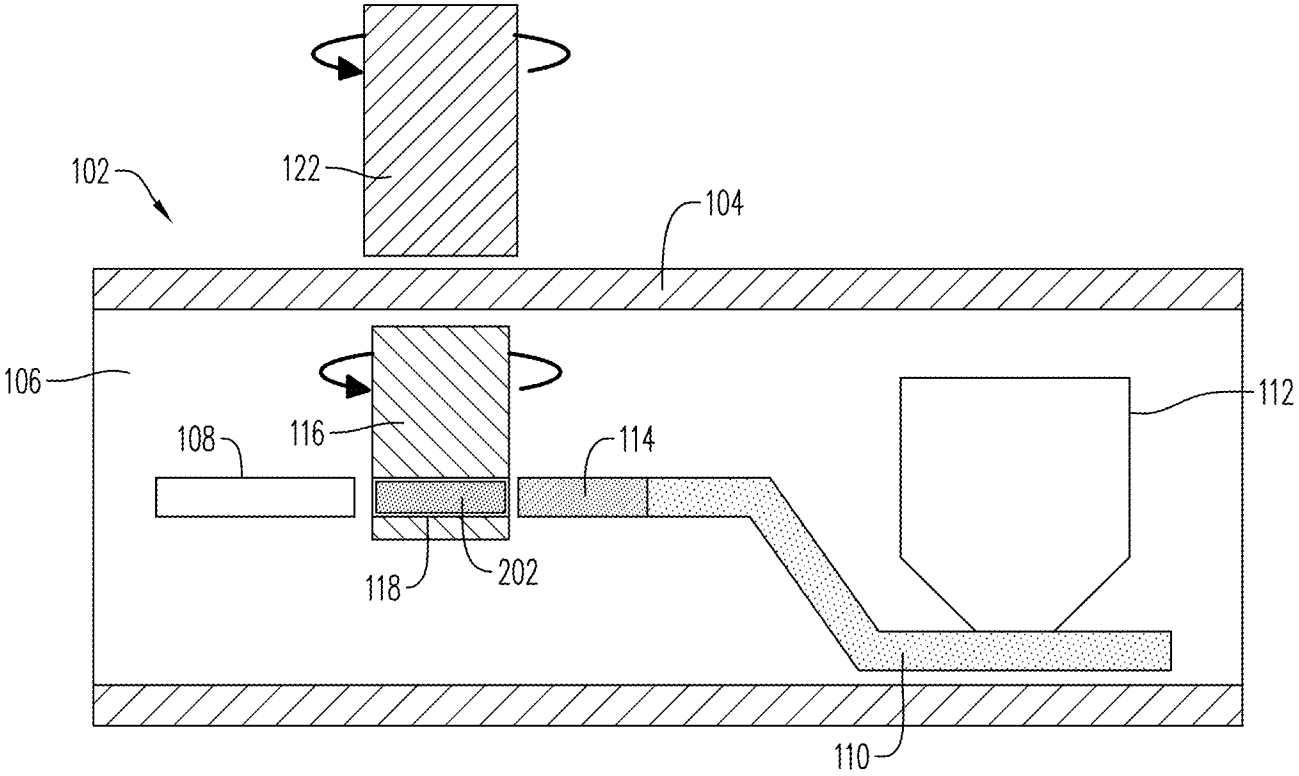
FIG. 7C is a cross-section view of a wellbore tool with a ballistic interrupt according to an exemplary embodiment.

It will further be understood that the movement of the interrupt from the unarmed position to the armed position is not limited to just one type of movement. FIG. 7A, FIG. 7B, and FIG. 7C shown an exemplary embodiment of a wellbore tool 102 with a ballistic interrupt that uses multiple types of movements to shift the interrupt 116 from an unarmed position to an armed position. For example, FIG. 7A shows the interrupt 116 in an unarmed position. In FIG. 7B, the interrupt 116 is first translated linearly in a radial direction of the housing 104 through application of a magnetic field, for example, a magnetic field provided by the magnet 122. Next, as seen in FIG. 7C, the interrupt 116 is rotated through application of a magnetic field so that the passage 118 becomes aligned with the initiator 108 and the first booster 114/detonating cord 110. In other words, the interrupt 116 is moved in a two-step bayonet-style movement. It will be understood that the movement steps are not limited to this order; for example, it may be possible to first rotate the interrupt 116 and then linearly translate it. It will be understood that the disclosure is not limited to one- or two-step movements of the interrupt 116, and that other movements such as a screw-type movement or multiple combinations of linear and rotational movement of interrupt 116 are possible. For example, in an exemplary embodiment, the movements of the interrupt 116 may include a combination of two or more of linearly moving the interrupt 116 through magnetic attraction, linearly moving the interrupt 116 through magnetic repulsion, rotating the magnet 122 around an axis perpendicular to an exterior surface of the housing 104, or rotating the magnet 122 around an axis parallel to a longitudinal axis 120 of the housing 104.

Figure 8B:
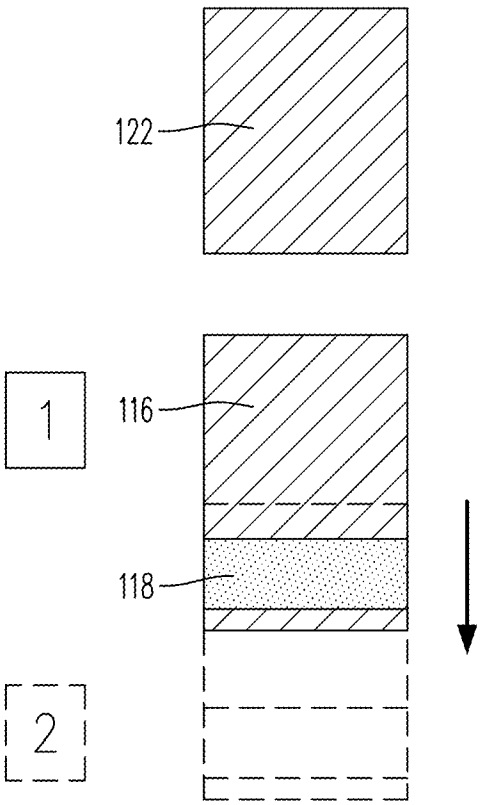
FIG. 8B is a schematic diagram showing movement of a ballistic interrupt via magnetic repulsion according to an exemplary embodiment.
Figure 8A:
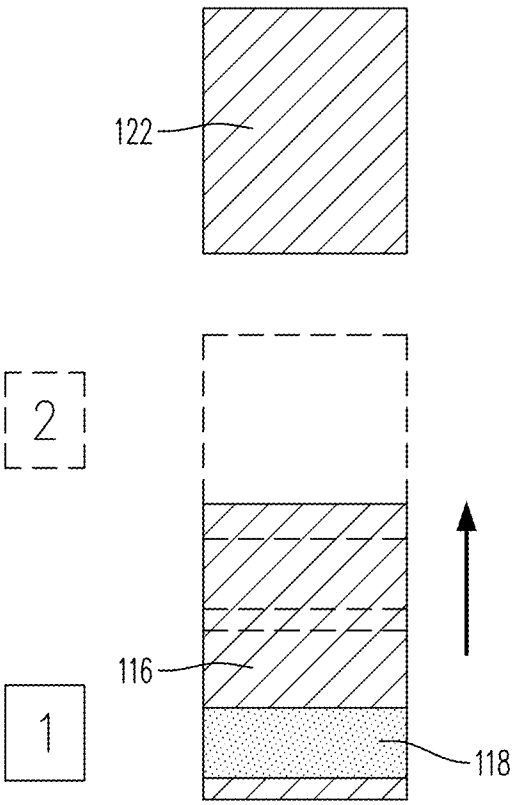
FIG. 8A is a schematic diagram showing movement of a ballistic interrupt via magnetic attraction according to an exemplary embodiment.
Figure 8D:
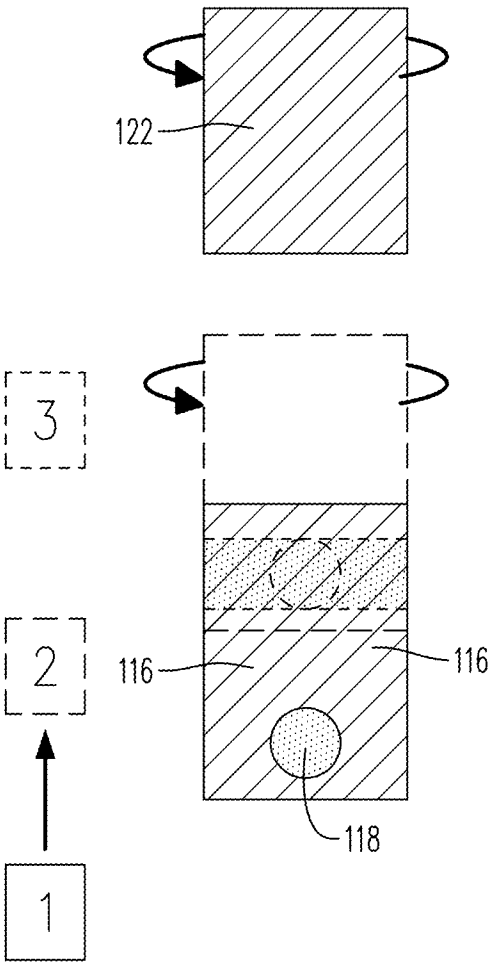
FIG. 8D is a schematic diagram showing movement of a ballistic interrupt via a combination of lateral translation and rotation according to an exemplary embodiment.
Figure 8C:
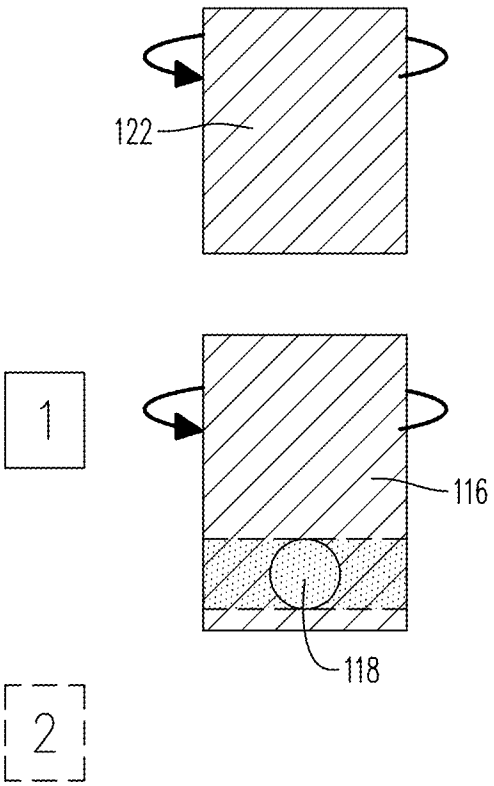
FIG. 8C is a schematic diagram showing movement of a ballistic interrupt via rotation of a magnet, according to an exemplary embodiment.
Figure 8E:
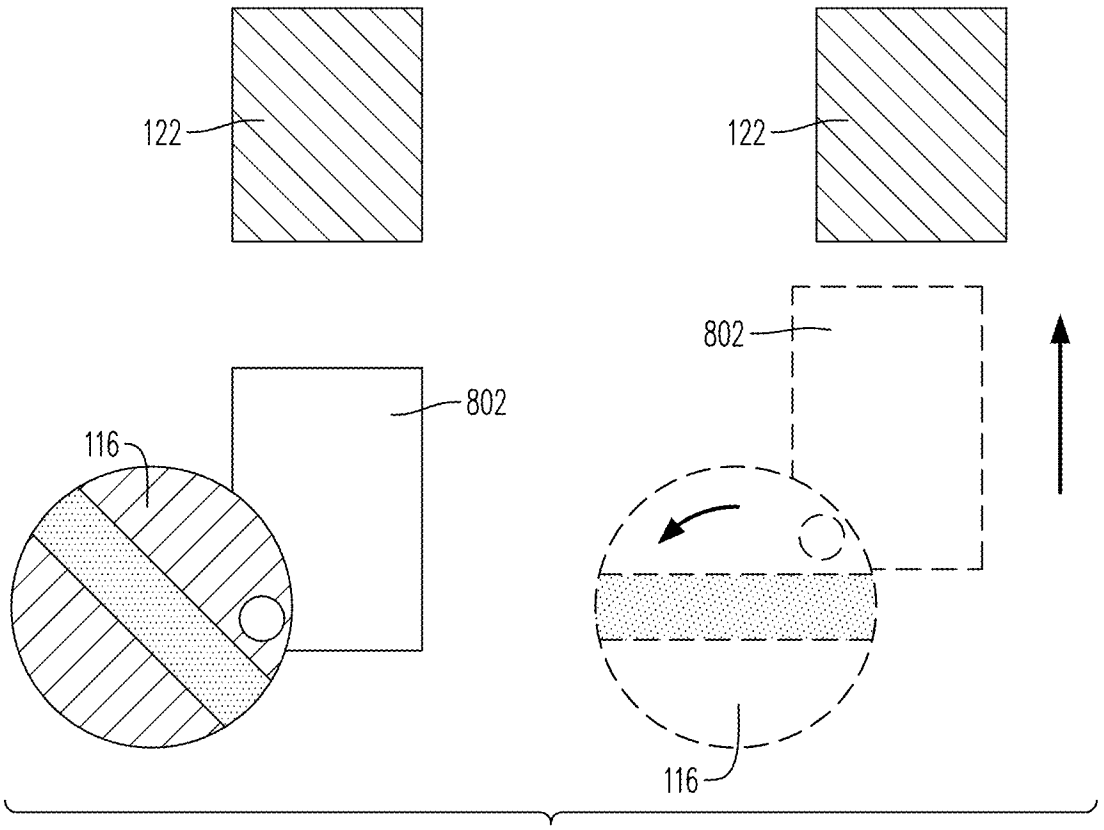
FIG. 8E is a schematic diagram showing movement of a ballistic interrupt via a mechanical connection to a magnetic component according to an exemplary embodiment.

FIG. 8A through FIG. 8E show various types of possible movements of the interrupt 116 in a simplified schematic form. FIG. 8A illustrates linear translation of the interrupt 116 through magnetic attraction, and FIG. 8B shows linear translation of the interrupt 116 through magnetic repulsion. FIG. 8C illustrates rotation of the magnet 122 and magnet 122, and FIG. 8D illustrates translation then rotation of the interrupt 116. FIG. 8E represents another possible mechanism for moving the interrupt 116. In FIG. 8E, the interrupt 116 itself may not be magnetic, but is instead rotatably mounted within the housing 104 and rotatably coupled to a magnetic component 802 via a connection. As seen in FIG. 8E, the magnetic component 802 may be linearly translated by application of a magnetic field. The linear translation of the magnetic component 802 may in turn cause rotation of the interrupt 116 to bring the passage 118 in alignment with the initiator 108 and first booster 114/detonating cord 110.

Alternatively, another method of moving the interrupt 116 would be place the magnet 122 or an electromagnet on or near a surface of the housing 104 and then moving the magnet 122 in a circumferential direction around the housing 104, which would rotate the interrupt 116 around an axis parallel to a longitudinal axis of the wellbore tool 102. For example, in an unarmed position, the passage 118 maybe circumferentially displaced by 90 degrees from alignment with the initiator 108. By moving the magnet 122 circumferentially around the housing 104 by 90 degrees, the passage 118 could be brought into alignment with the initiator 108.

Figure 9B:
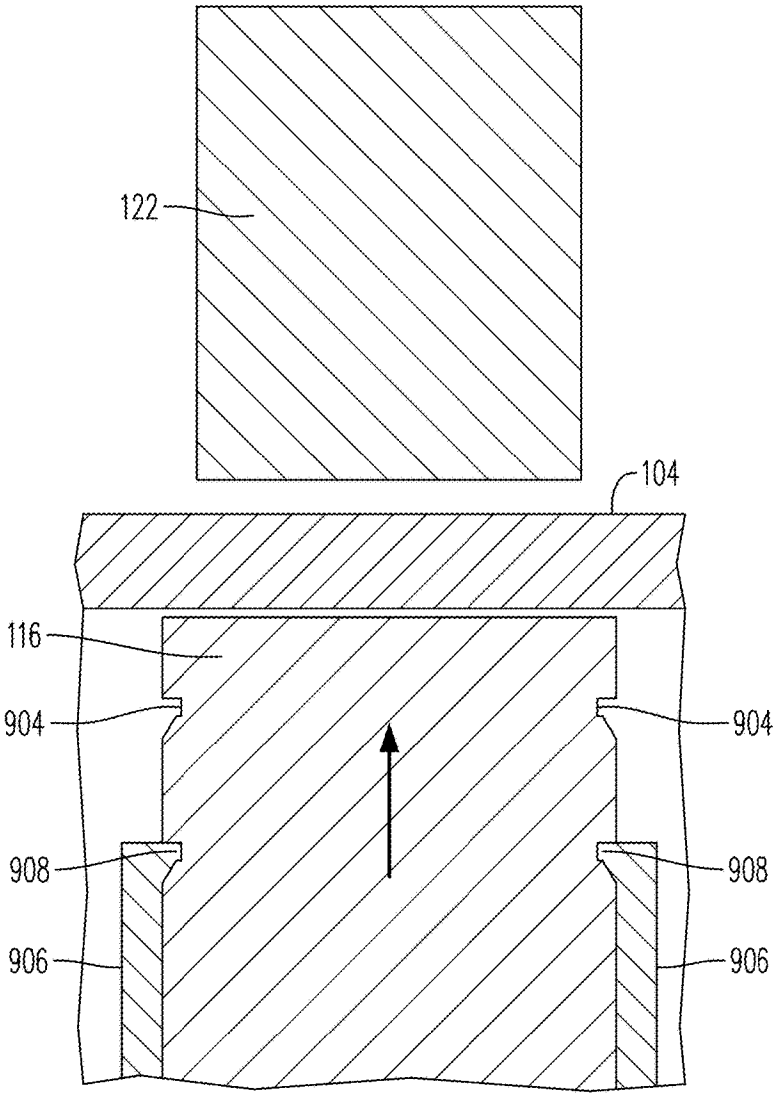
FIG. 9B is a cross-section view of a wellbore tool with a ballistic interrupt and retention mechanism according to an exemplary embodiment.
Figure 9A:
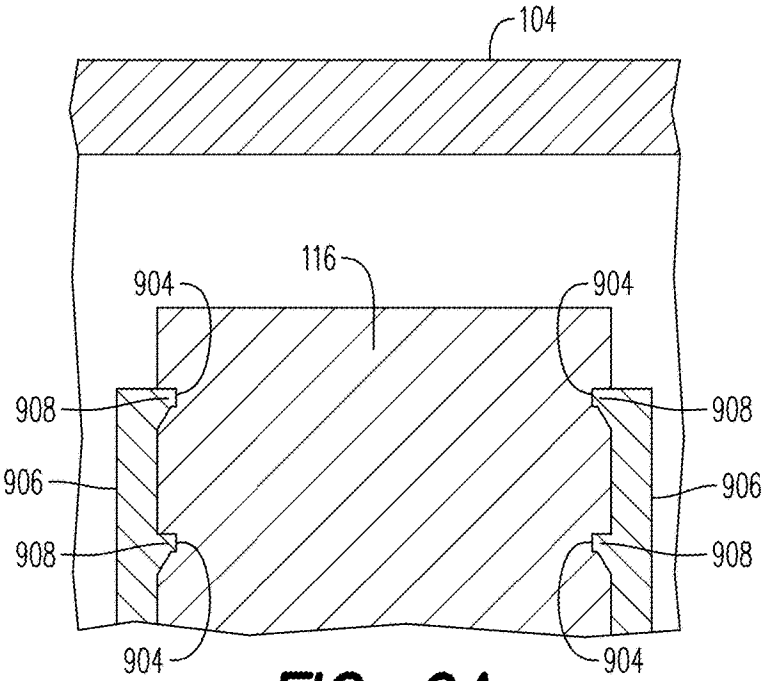
FIG. 9A is a cross-section view of a wellbore tool with a ballistic interrupt and retention mechanism according to an exemplary embodiment.

For safety purposes, it may be helpful to prevent movement of the interrupt 116 unless actuated by the magnet 122, which could help to prevent accidental arming of the wellbore tool 102 during transport or handling at the wellbore site. In an exemplary embodiment, this may be accomplished by the use of a retention mechanism in the perforating gun. As seen in FIG. 9A and FIG. 9B, in an exemplary embodiment the interrupt 116 may be configured with one or more sets of retention grooves 904 formed in an outer surface of the interrupt 116. The interrupt 116 may then be mounted in a mounting structure that includes one or more corresponding retention arms 906 with retention projections 908 configured to fit into the retention grooves 904 of the interrupt 116. The combination of the retention grooves 904 and the retention arms 906 may provide a force that maintains the interrupt 116 in the unarmed position. The retention grooves 904 and the retention arms 906 could be configured to release the interrupt 116 and allow movement under application of a sufficient force such as that generated by the application of the magnetic field. In other words, the retention mechanism may be configured to release the interrupt 116 from the unarmed position in response to application of a force greater than a predetermined threshold force.

Similarly, another set of retention arms/retention grooves could be used to hold the interrupt 116 in the armed position following application of the magnet 122, thereby preventing accidental disarming of the wellbore tool 102 during deployment to the wellbore. It will further understood that the positions of the retention grooves 904 and the retention arms 906 may be reversed, for example, the retention arms and tips may be provided on the interrupt 116, and the corresponding retention grooves may be provided on the mounting structure within the housing 104.

Figure 10A:
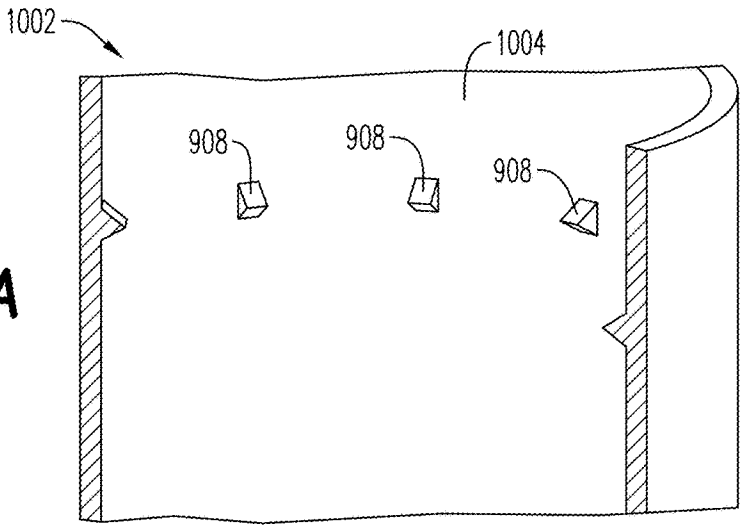
FIG. 10A is a perspective cutaway view of a retention mechanism according to an exemplary embodiment.
Figure 10B:
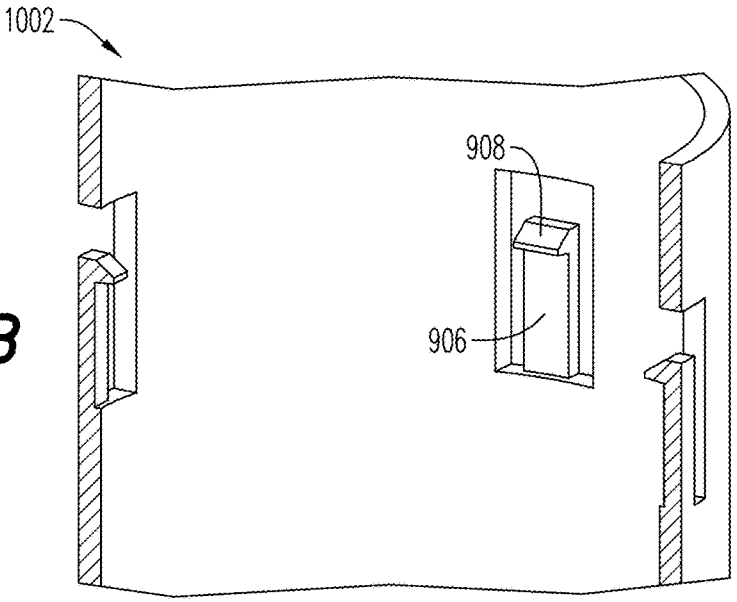
FIG. 10B is a perspective cutaway view of a retention mechanism according to an exemplary embodiment.

FIG. 10A and FIG. 10B show additional possible embodiments of retention mechanisms, though it will be understood that the disclosure is not limited to these embodiments. As seen in FIG. 10A, the retention mechanism may be configured as a cylinder 1002, with the retention projections 908 projecting from an interior surface 1004 of the cylinder 1002. Alternatively, as seen in FIG. 10B, the retention arm 906 and the retention projection 908 may be punched out from the cylinder 1002.

Figure 11:
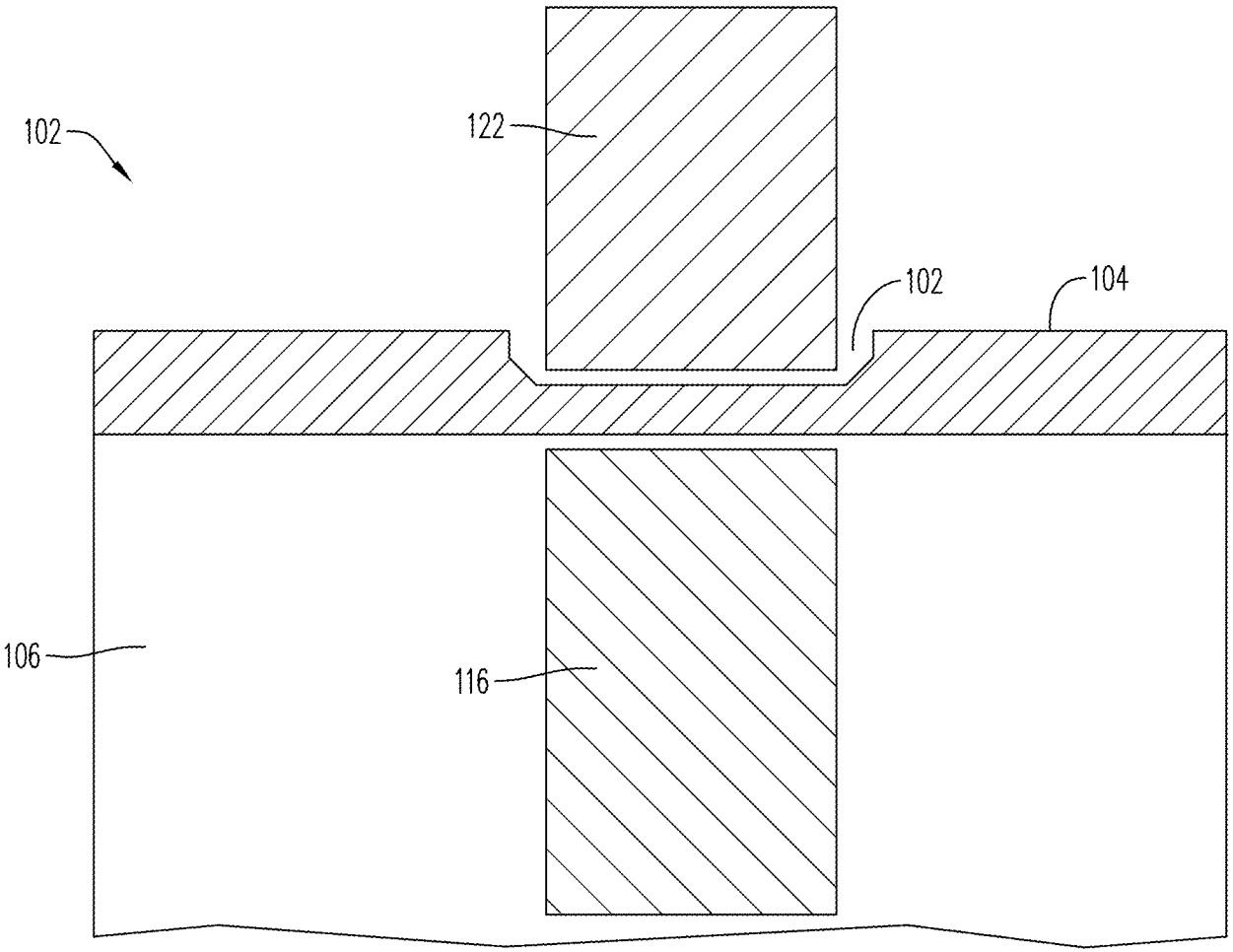
FIG. 11 is a cross-section view of a perforating gun with a ballistic interrupt according to an exemplary embodiment.

FIG. 11 shows an exemplary embodiment of a manner for indicating proper placement of a magnet 122 on an exterior of the housing 104 in order to move the interrupt 116. For example, FIG. 11 shows that the housing 104 may include a depression 1102 into which the magnet 122 may be placed. The internal structure of the wellbore tool 102 may be configured such that the interrupt 116 would be positioned proximate to the depression 1102, such that placement of a magnet 122 at the depression 1102 would move the interrupt 116 in order to arm the wellbore tool 102. It will be understood that the disclosure is not limited to the depression 1102 shown in FIG. 11. For example, the housing 104 may be marked with small cuts or divots indicating where the magnet 122 should be placed. Alternatively, target markings or other symbols or words may be provided on an exterior surface of the housing 104 via printing, etching, attachment of labels, or other suitable means in order to indicate proper placement of the magnet 122.

Figure 12:
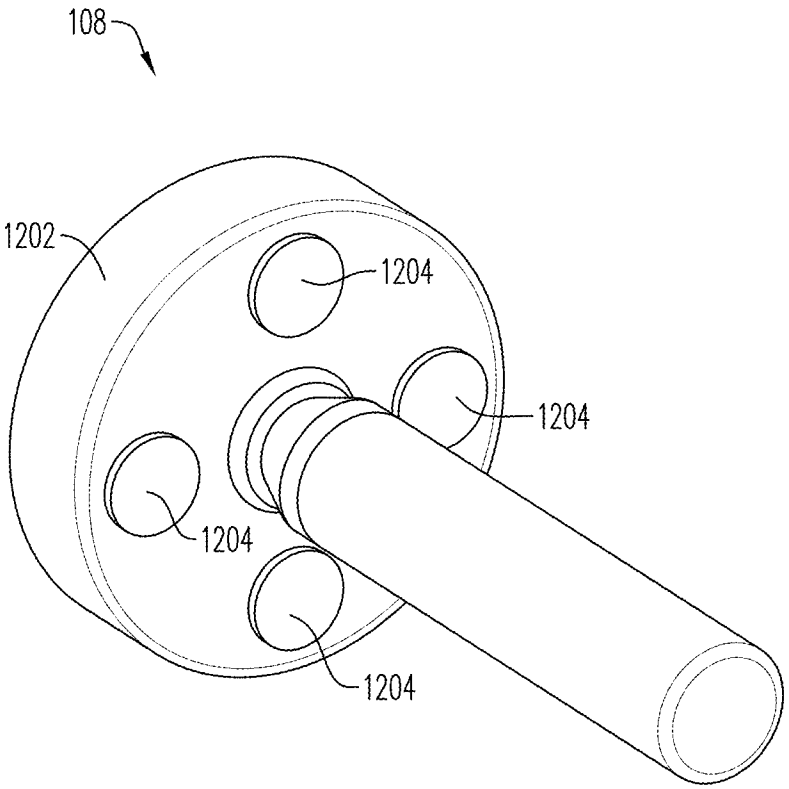
FIG. 12 is a perspective view of an initiator according to an exemplary embodiment.

In using a wellbore tool 102 according to this disclosure, it may be helpful for a user to detect an confirm whether the interrupt 116 has been moved to an arming position. This may be achieved by using a detection circuit. The detection circuit may be provided in an initiator 108 provided within the perforating gun; FIG. 12 shows an exemplary embodiment of an initiator 108 having multiple electrical contacts 1204 provided on an exterior of an initiator head 1202. In an exemplary embodiment, two of the electrical contact 1204 on the initiator head 1202 may be in electrical communication with the detection circuit. The initiator heads 1202 may be configured to make electrical contact with electrical leads provided within the wellbore tool 102 once the initiator 108 is properly positioned within the perforating gun.

Figure 13A:
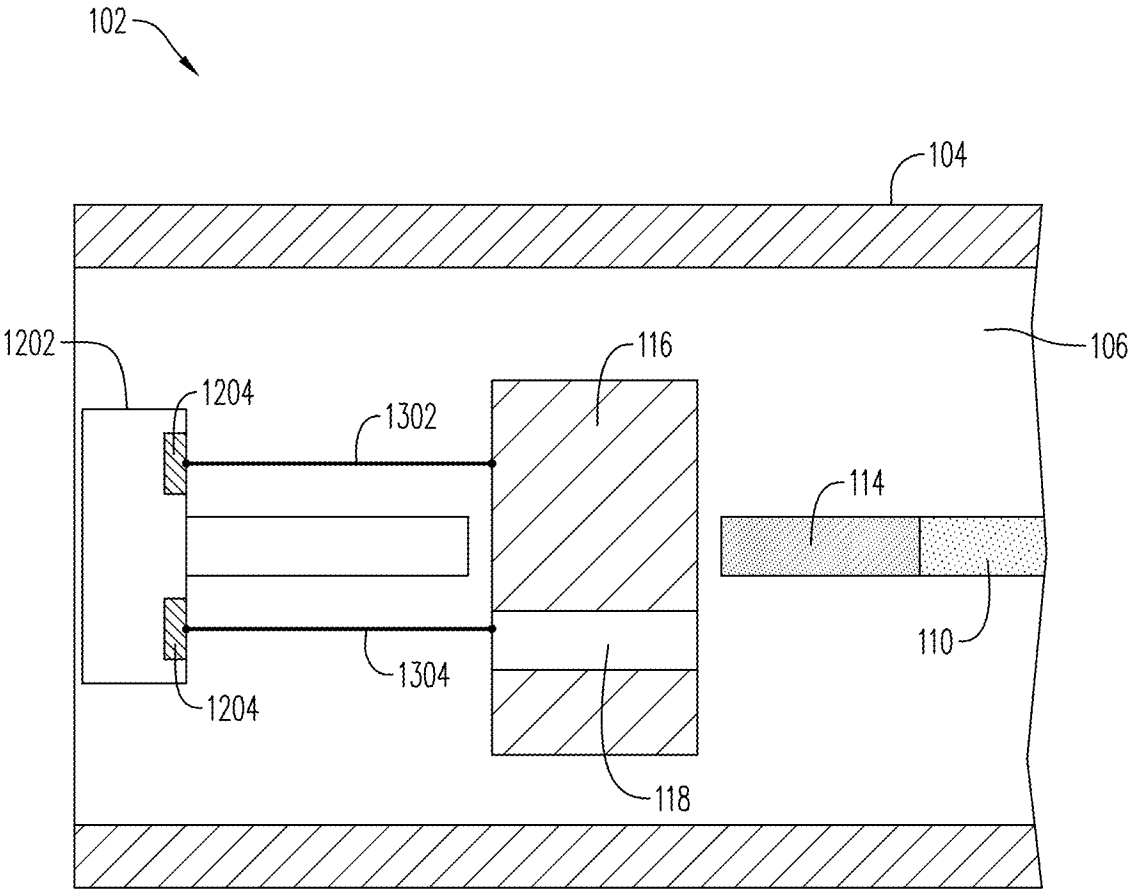
FIG. 13A is a cross-section view of a wellbore tool with a ballistic interrupt and detection circuit according to an exemplary embodiment.

Detection of the position of the interrupt 116 may be determined based on whether the detection circuit detects an open or floating circuit. For example, FIG. 13A shows an exemplary embodiment in which the interrupt 116 is in a disarmed position. In FIG. 13A, the electrical contacts 1204 are connected to a first electrical lead 1302 and a second electrical lead 1304. In the state shown in FIG. 13A, the detection circuit would detect an open circuit because the second electrical lead 1304 is aligned with the passage 118 of the interrupt 116; i.e., one end the second electrical lead 1304 is floating and is not in electrical communication with anything. Thus, the detection circuit would not detect a current flow or voltage change at the second electrical lead 1304.

Figure 13B:
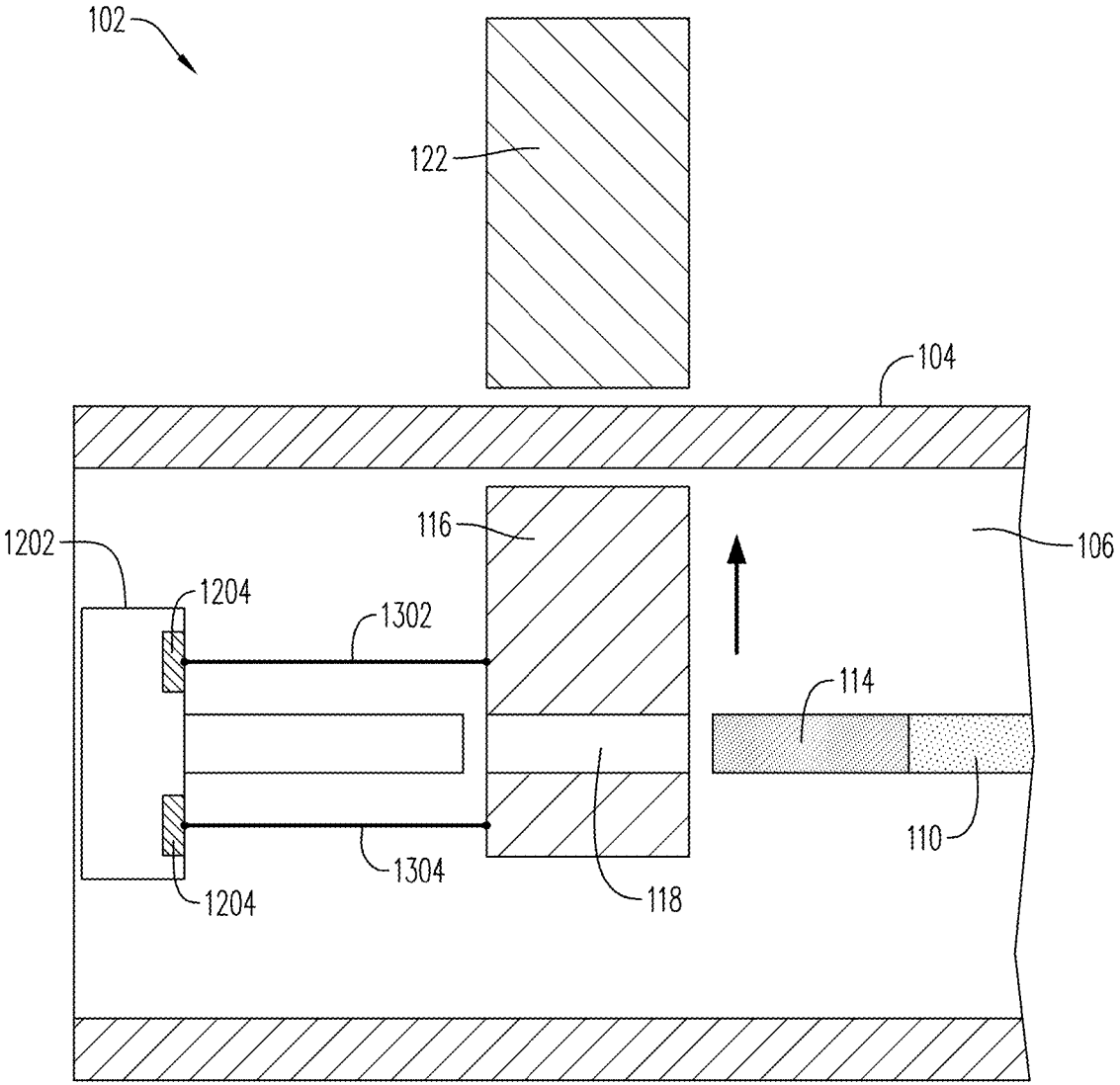
FIG. 13B is a cross-section view of a wellbore tool with a ballistic interrupt according to an exemplary embodiment.

In contrast, FIG. 13B shows an exemplary embodiment in which the interrupt 116 is in an armed position. In the state shown in FIG. 13B, the detection circuit would detect a closed circuit because both the first electrical lead 1302 and the second electrical lead 1304 are in contact with the interrupt 116. If the interrupt 116 is formed from an electrically conductive material, then this would create a closed circuit detectable by the detection circuit, such as through detection of a current draw or voltage change. Alternatively, the interrupt 116 may have an electrical pathway formed through it and be configured to only contact the leads of the detection circuit when the interrupt 116 is in the armed position.

It will be understood that the detection circuit is not limited to detecting an open circuit in the unarmed position and a closed circuit in the armed position. For example, the detection circuit and interrupt 116 may be configured such that the detection circuit detects a closed circuit when the interrupt 116 is in the unarmed position and detects an open circuit when the interrupt 116 is in the armed position.

While the discussions above have described exemplary embodiments in terms of moving the interrupt 116 from the unarmed position to the armed position, it will be understood that the process may also be reversible, i.e., the interrupt 116 can be moved from the armed position to the unarmed position via external manipulation of the magnet 122 without directly contacting the interior components of the wellbore tool 102. This is a beneficial safety feature because, in the event that a tool string is removed from the wellbore, it is important to disarm the wellbore tools 102 to prevent accidental detonation that could injure workers and/or damage equipment. The detection circuit described above could be used to verify that the wellbore tools 102 are disarmed.

Figure 14:
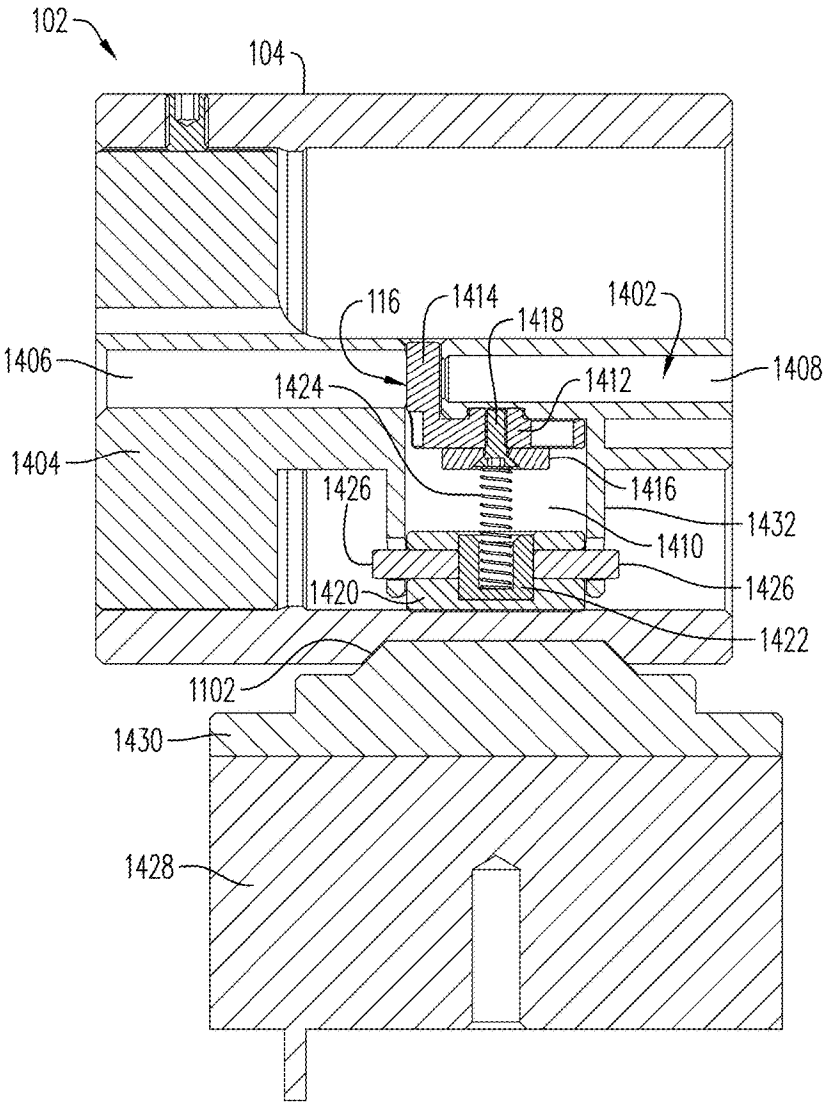
FIG. 14 is a cross-section view of a wellbore tool with a ballistic interrupt according to an exemplary embodiment.
Figure 15B:
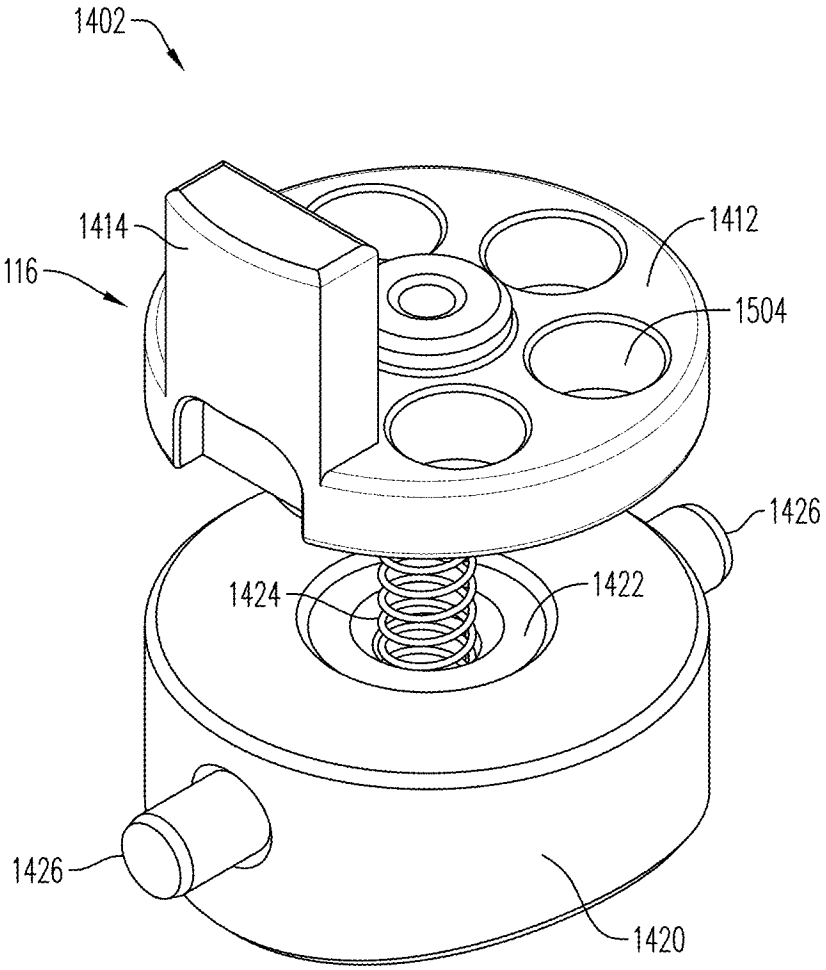
FIG. 15B is a perspective view of an interrupt assembly according to an exemplary embodiment.
Figure 15A:
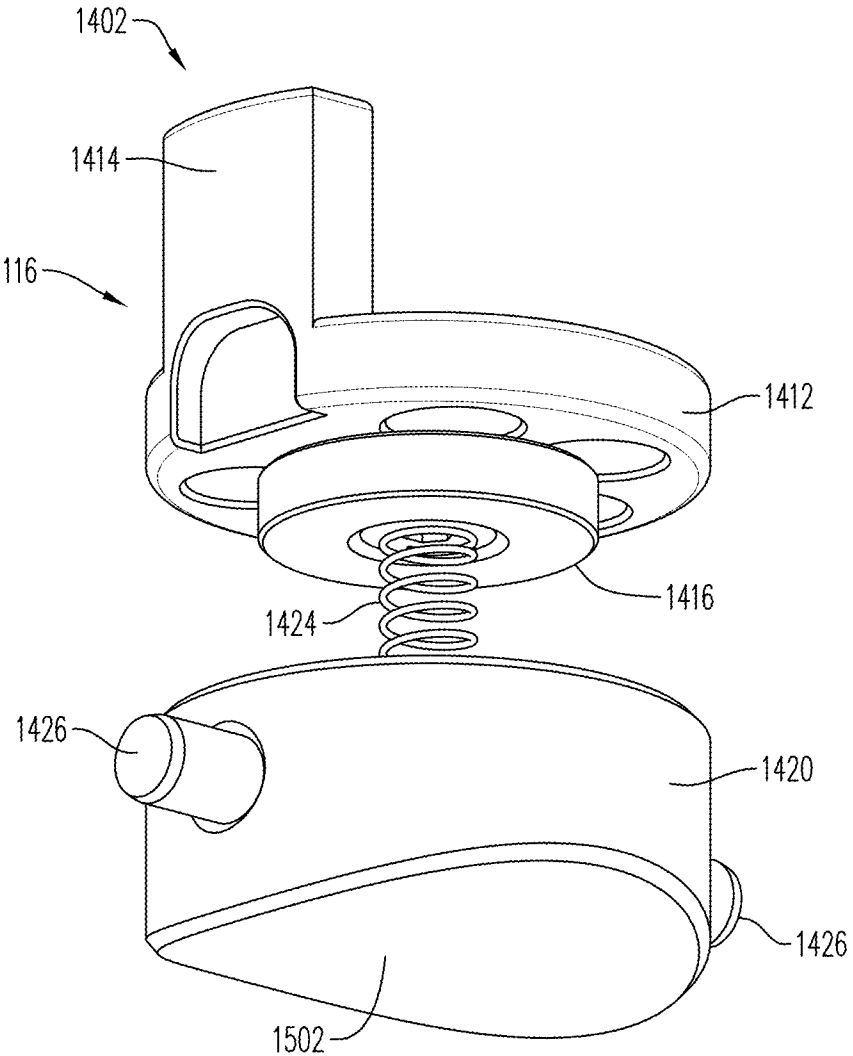
FIG. 15A is a perspective view of an interrupt assembly according to an exemplary embodiment.
Figure 15C:
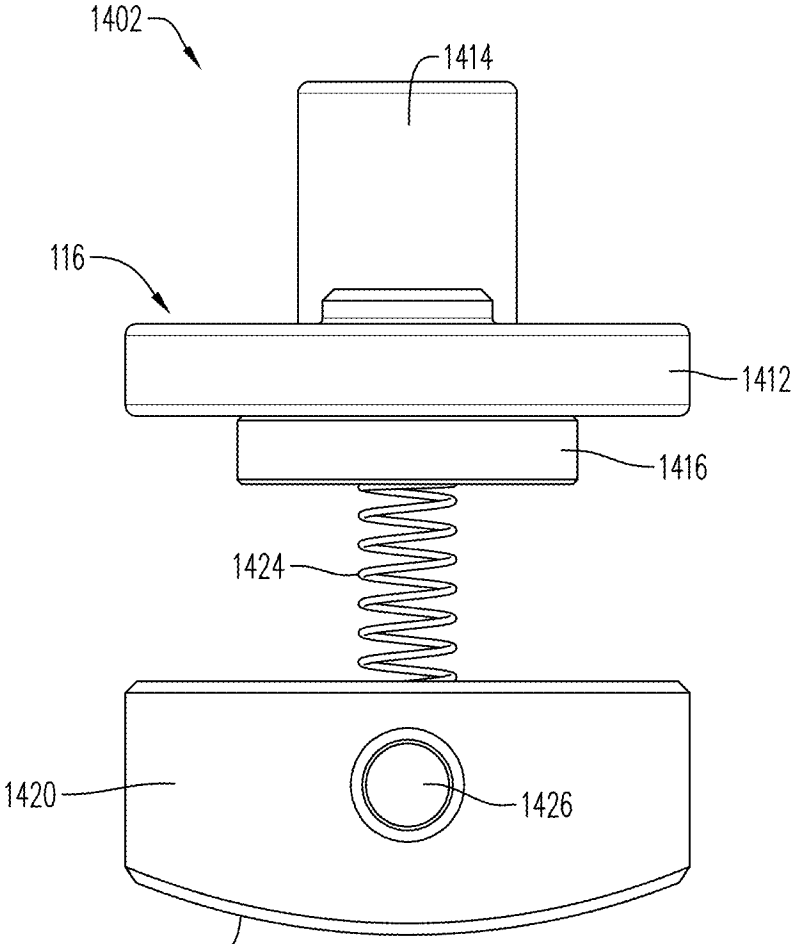
FIG. 15C is a side view of an interrupt assembly according to an exemplary embodiment.

FIG. 14 shows a cross-sectional view of a wellbore tool 102 with a ballistic interrupt assembly 1402 in an unarmed configuration. FIG. 15A, FIG. 15B, and FIG. 15C show isolated views of an exemplary embodiment of the interrupt assembly 1402. The wellbore tool 102 may include an explosive component holder such as an initiator holder 1404. The initiator holder 1404 may have a first channel such as an initiator channel 1406 and a second channel such as a cord channel 1408 provided therein. In an exemplary embodiment, a first explosive component such as the initiator 108 (see FIG. 12) may be received in the initiator channel 1406, and a second explosive component such as the detonating cord 110 or the first booster 114 (see FIG. 1) may be received in the cord channel 1408. The initiator holder 1404 may further include an interrupt channel 1410 configured to retain at least a portion of the interrupt assembly 1402 in position. The interrupt channel 1410 may be formed as a substantially cylindrical shape extending from the initiator channel 1406 and the cord channel 1408.

The interrupt assembly 1402 may include the interrupt 116, which may include an interrupt base 1412 formed as a flat disk, an interrupt body 1414 extending substantially perpendicularly from the interrupt base 1412, and a ring magnet 1416 coupled to the interrupt base 1412. In the unarmed configuration, the interrupt body 1414 may be positioned between the initiator channel 1406 and the cord channel 1408 so as to block any detonation from the initiator 108 in the initiator channel 1406 from reaching the detonating cord 110 or the first booster 114 in the cord channel 1408. As seen in FIG. 15B, the interrupt base 1412 may include one or more holes 1504 formed therethrough. The holes 1504 may help to reduce mass of the interrupt 116, which may reduce the amount of magnetic attraction force necessary to pull the ring magnet 1416 and the interrupt 116 to the activator block 1420 as described below.

The ring magnet 1416 may be coupled to the interrupt base 1412 via a fastener 1418 such a screw, bolt, snap connector, or the like. Alternatively, an adhesive or solder may be used to couple the ring magnet 1416 to the fastener 1418. The ring magnet 1416 may be a permanent magnet. In an exemplary embodiment, the ring magnet 1416 may include neodymium.

The interrupt assembly 1402 may further include an activator block 1420. The activator block 1420 may be formed of a material that is non-magnetic by default, but may become magnetic once a magnetic field or magnetic impulse is applied to the activator block 1420. In other words, the activator block 1420 may be formed of a material that is magnetizable, and may be switched between a non-magnetized state and a magnetized state. The activator block 1420 may include a recess for receiving a bias element receptacle 1422 therein. The bias element receptacle 1422 may be press fit into the recess of the activator block 1420. Alternatively, the bias element receptacle 1422 may be fixed in the activator block 1420 using mounting pins 1426 (described below) or other fasteners, adhesives, solders, or the like. In an exemplary embodiment, the activator block 1420 and/or the interrupt 116 may include a ferromagnetic material. In an exemplary embodiment, the activator block 1420 and/or the interrupt 116 may include a steel with a high iron content. In an exemplary embodiment, the activator block 1420 and/or the interrupt 116 may include S235JRG2 structural steel.

The interrupt assembly 1402 may further include a bias element 1424 such as a spring having a first end received in the bias element receptacle 1422 and a second end connected to the ring magnet 1416 and/or the ring magnet 1416 (for example, the fastener 1418 may also be used to fix the second end of the bias element 1424). Alternatively, the second end of the bias element 1424 may simply abut against the ring magnet 1416 and/or the fastener 1418. The bias element 1424 may exert a bias force sufficient to keep the interrupt body 1414 in place between the initiator channel 1406 and the cord channel 1408 when the interrupt assembly 1402 is in the unarmed configuration. In other words, the bias force exerted by the bias element 1424 should be greater than any magnetic attraction force between the ring magnet 1416 and the activator block 1420 when the activator block 1420 is in a non-magnetic state. This will help to prevent unintentional arming of the wellbore tool 102.

In one possible exemplary embodiment, interrupt assembly 1402 may further include one or more mounting pins 1426. The mounting pins 1426 may extend through holes in the activator block 1420 and couple to the bias element receptacle 1422 in order to secure the bias element receptacle 1422 within the activator block 1420. Additionally, outer ends of the mounting pins 1426 may extend through holes in a sidewall 1432 of the interrupt channel 1410 so as to retain the activator block 1420 in place and restrict a movement range of the activator block 1420. While FIG. 14 and FIG. 15A-FIG. 15C, the disclosure does not require the mounting pins 1426. For example, the activator block 1420 may be secured within the interrupt channel 1410 through alternative means such as friction fit, o-rings, adhesive, and/or fasteners.

In order to transition the interrupt assembly 1402 from the unarmed configuration to an armed configuration, a magnetic impulse may be applied to the interrupt assembly 1402. For example, an electromagnet 1428 may be used to supply the magnetic impulse to the interrupt assembly 1402. A magnet adapter 1430 configured to fit within a depression 1102 in the housing 104 may be coupled to the electromagnet 1428 to ensure that the magnetic impulse is applied in the proper location. In an exemplary embodiment, the depression 1102 may be positioned radially outward from the activator block 1420, and the depression 1102 may overlap with the activator block 1420 in the axial and circumferential directions such that the depression is directly aligned with the activator block 1420. By applying the magnetic impulse, the activator block 1420 may become magnetized. Once the activator block 1420 is magnetized, the magnetic attraction force between the ring magnet 1416 and the activator block 1420 increases to the point where it overcomes the biasing force of the bias element 1424. This increased magnetic attraction force causes the ring magnet 1416 (and consequently, the interrupt 116) to displace in the radial direction of the wellbore tool 102 and contact the magnetized activator block 1420. In an exemplary embodiment, the magnetic attraction force between the ring magnet 1416 and the activator block 1420 may be in a range of 3400 N to 26000 N. This movement of the interrupt 116 removes the interrupt body 1414 from its unarmed position between the initiator channel 1406 and the cord channel 1408. With the interrupt body 1414 removed from this position, the initiator channel 1406 is in energetic communication with the cord channel 1408, and the wellbore tool 102 is thereby armed. In an exemplary embodiment, the magnetic impulse may be generated by supplying an electric current of 2 amps at 24 volts to the electromagnet 1428. In an exemplary embodiment, the magnetic impulse may be applied for a duration less than or equal to 1 second. In an exemplary embodiment, the magnetic impulse may be applied for a duration in a range of 1 millisecond to 500 milliseconds.

In order to ensure reliable magnetization of the activator block 1420, it may be helpful to minimize any air gap between the activator block 1420 and an interior surface of the housing 104. In an exemplary embodiment, this air gap may be in a range of 0 mm to 5 mm. To facilitate minimization of this air gap, the activator block 1420 may be formed with a contoured surface 1502 (see FIG. 15A and FIG. 15C) configured to fit closely against an interior surface of the housing 104.

Figure 16:
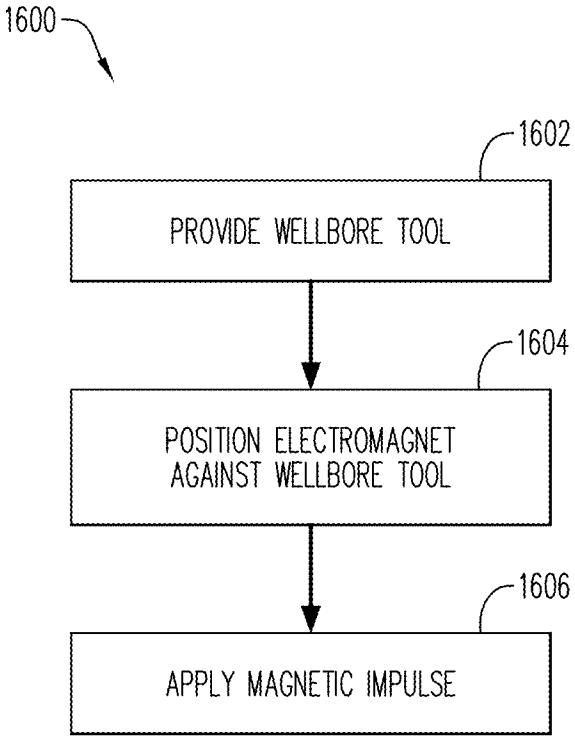
FIG. 16 is a flowchart of a method for arming a wellbore tool according to an exemplary embodiment.

FIG. 16 describes an exemplary embodiment of a method 1600 for arming a wellbore tool. In block 1602, a wellbore tool is provided. The wellbore tool may be a wellbore tool 102 having an interrupt assembly 1402 as described above with reference to FIG. 14 and FIG. 15A through FIG. 15C. In method block 1604, an electromagnet may be positioned against the wellbore tool. In an exemplary embodiment, the electromagnet may be positioned by using depression 1102 as a guide. In block 1606, the electromagnet is controlled to apply a magnetic impulse to the wellbore tool. In an exemplary embodiment, this magnetic impulse may cause the activator block 1420 of the interrupt assembly 1402 to become magnetized, thereby attracting the ring magnet 1416 and thus arming the wellbore tool. As described above, in an exemplary embodiment, the magnetic impulse may be generated by applying a current of 2 amps at 24 volts to the electromagnet. In an exemplary embodiment, the magnetic impulse may be applied for a duration less than or equal to 1 second. In an exemplary embodiment, the magnetic impulse may be applied for a duration in a range of 1 millisecond to 500 milliseconds.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchange ably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower", etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A ballistic interrupt assembly comprising:
an interrupt;
a magnet coupled to the interrupt;
an activator block formed of a magnetizable material and configurable between a non-magnetized state and a magnetized state; and
a bias element provided between the magnet and the activator block;
wherein a bias force of the bias element is greater than a first magnetic attraction force between the magnet and the activator block in the non-magnetized state; and
the bias force of the bias element is less than a second magnetic attraction force between the magnet and the activator block in the magnetized state.

2. The ballistic interrupt assembly of claim 1, wherein the interrupt comprises:
an interrupt base formed as a flat disk; and
an interrupt body extending substantially perpendicularly from the interrupt base;
wherein the magnet is fixed to the interrupt base.

3. The ballistic interrupt assembly of claim 1, wherein the activator block comprises a ferromagnetic material.

4. The ballistic interrupt assembly of claim 3, wherein the activator block comprises a magnetizable steel.

5. The ballistic interrupt assembly of claim 1, wherein the magnet comprises neodymium.

6. The ballistic interrupt assembly of claim 1, wherein:
the activator block comprises a recess;
a first end of the bias element is received within the recess.

7. A wellbore tool comprising:
a housing;
an explosive component holder disposed within the housing, the explosive component holder comprising:
a first channel configured for receiving a first explosive component; and
a second channel configured for receiving a second explosive component;
a ballistic interrupt assembly comprising an interrupt movable between a first position and a second position;
wherein in the first position, the interrupt blocks ballistic transfer between the first channel and the second channel such that the wellbore tool is unarmed;
in the second position, the interrupt allows ballistic transfer between the first channel and the second channel such that the perforating gun is armed; and
the interrupt is configured to move from the first position to the second position via application of a magnetic field to the wellbore tool.

8. The wellbore tool of claim 7, wherein:
the first explosive component is an initiator; and
the second explosive component is a detonating cord or a booster.

9. The wellbore tool of claim 7, wherein the ballistic interrupt assembly further comprises:
a magnet coupled to the interrupt;
an activator block formed of a magnetizable material and configurable between a non-magnetized state and a magnetized state; and
a bias element provided between the magnet and the activator block;
wherein a bias force of the bias element is greater than a first magnetic attraction force between the magnet and the activator block in the non-magnetized state;
the bias force of the bias element is less than a second magnetic attraction force between the magnet and the activator block in the magnetized state;
in first position, at least a portion of the interrupt is positioned between the first channel and the second channel; and
in the second position the interrupt is displaced from between the first channel and the second channel.

10. The wellbore tool of claim 9, further comprising a depression formed on an exterior surface of the housing;
wherein the depression is aligned with the activator block.

11. The wellbore tool of claim 9, wherein the interrupt comprises:
an interrupt base formed as a flat disk; and
an interrupt body extending substantially perpendicularly from the interrupt base;
wherein the magnet is fixed to the interrupt base.

12. The wellbore tool of claim 7, wherein the activator block comprises a ferromagnetic material.

13. The wellbore tool of claim 7, wherein the magnet comprises neodymium.

14. The wellbore tool of claim 9, further comprising:
an interrupt channel formed in the explosive component holder;
wherein the ballistic interrupt assembly is disposed within the interrupt channel.

15. The wellbore tool of claim 14, wherein:
the activator block comprises a recess;
a first end of the bias element is received within the recess.

16. The wellbore tool of claim 7, further comprising a detection circuit configured to determine whether the interrupt is in the first position or the second position.

17. A wellbore tool arming method comprising:
providing a wellbore tool comprising:
a housing;

an explosive component holder disposed within the housing, the explosive component holder comprising:

a first channel configured for receiving a first explosive component; and a second channel configured for receiving a second explosive component;

a ballistic interrupt assembly comprising:

an interrupt;

a magnet coupled to the interrupt;

an activator block formed of a magnetizable material and configurable between a non-magnetized state and a magnetized state; and a bias element provided between the magnet and the activator block;

wherein a bias force of the bias element is greater than a first magnetic attraction force between the magnet and the activator block in the non-magnetized state;

the bias force of the bias element is less than a second magnetic attraction force between the magnet and the activator block in the magnetized state; and the interrupt is movable between a first position in which at least a portion of the interrupt is positioned between the first channel and the second channel and a second position in which the interrupt is displaced from between the first channel and the second channel moving the interrupt from the first position to the second position.

18. The wellbore tool arming method of claim 17, wherein the moving the interrupt from the first position to the second position comprises magnetizing the activator block.

19. The wellbore tool arming method of claim 18, wherein magnetizing the activator block comprises:

positioning an electromagnet against an outer surface of the housing; and activating the electromagnet to generate a magnetic field.

20. The wellbore tool arming method of claim 19, wherein the electromagnet is activated for a duration in a range of 1 millisecond to 500 milliseconds.

* * * * *